US006988538B2

(12) United States Patent
Merkys et al.

(10) Patent No.: US 6,988,538 B2
(45) Date of Patent: Jan. 24, 2006

(54) MICROCHANNEL CONDENSER ASSEMBLY

(75) Inventors: Justin P. Merkys, Barrington, IL (US); Doug McAlpine, Bartlett, IL (US); Susan A. Seaman, Streamwood, IL (US); Norman E. Street, O'Fallon, MO (US)

(73) Assignee: Hussmann Corporation, Bridgeton, MO (US)

( * ) Notice: Subject to any disclaimer, the term of this patent is extended or adjusted under 35 U.S.C. 154(b) by 0 days.

(21) Appl. No.: 10/762,416

(22) Filed: Jan. 22, 2004

(65) Prior Publication Data

US 2005/0161202 A1 Jul. 28, 2005

(51) Int. Cl.
*F28F 1/10* (2006.01)

(52) U.S. Cl. ..... 165/122; 29/890.03; 165/175

(58) Field of Classification Search ..... 165/122, 165/144, 145, 173, 175; 29/890.03, 890.035
See application file for complete search history.

(56) References Cited

U.S. PATENT DOCUMENTS

| | | | | |
|---|---|---|---|---|
| 2,124,291 | A | | 7/1938 | Fleisher |
| 3,384,165 | A | * | 5/1968 | Mathews ..... 165/122 |
| 3,584,466 | A | | 6/1971 | Kaufman et al. |
| 3,627,037 | A | | 12/1971 | Carr, Jr. |
| 3,707,185 | A | | 12/1972 | Modine et al. |
| 3,840,067 | A | | 10/1974 | Bos |
| 4,607,497 | A | | 8/1986 | Ferdows et al. |
| 4,852,362 | A | | 8/1989 | Conry |
| 4,998,580 | A | | 3/1991 | Guntly et al. |
| 5,070,704 | A | | 12/1991 | Conry |
| 5,121,613 | A | * | 6/1992 | Cox et al. ..... 165/150 |
| 5,190,100 | A | | 3/1993 | Hoshino et al. |
| 5,279,360 | A | * | 1/1994 | Hughes et al. ..... 165/111 |
| 5,529,116 | A | * | 6/1996 | Sasaki et al. ..... 165/144 |
| RE35,655 | E | | 11/1997 | Hoshino et al. |
| 5,743,328 | A | * | 4/1998 | Sasaki et al. ..... 165/144 |
| 5,765,393 | A | * | 6/1998 | Shlak et al. ..... 165/146 |
| 6,003,592 | A | * | 12/1999 | Yamamoto et al. ..... 165/110 |
| 6,021,846 | A | | 2/2000 | Sasaki et al. |
| 6,481,216 | B2 | | 11/2002 | Simmons et al. |

* cited by examiner

*Primary Examiner*—Teresa J. Walberg
(74) *Attorney, Agent, or Firm*—Michael Best & Friedrich LLP

(57) ABSTRACT

A condenser assembly adapted to condense an evaporated refrigerant for use in a retail store refrigeration system. The condenser assembly includes at least one microchannel condenser coil including an inlet manifold and an outlet manifold. The inlet manifold includes an inlet port for receiving the refrigerant, and the outlet manifold includes an outlet port for discharging the refrigerant. The condenser assembly also includes a frame supporting the at least one microchannel condenser coil.

28 Claims, 12 Drawing Sheets

MICROCHANNEL CONDENSER ASSEMBLY

FIELD OF THE INVENTION

This invention relates generally to condenser coils, and more particularly to condenser coils for use in retail store refrigeration systems.

BACKGROUND OF THE INVENTION

Typical retail store refrigeration systems often utilize conventional fin-and-tube condenser coils to dissipate heat from refrigerant passing through the condenser coils. Usually, in large-scale retail store refrigeration systems, a singular, oftentimes large, conventional fin-and-tube condenser coil is sized to dissipate, or reject, an amount of heat equal to the heat load of the refrigeration system. In other words, the singular fin-and-tube condenser coil is sized to dissipate the amount of heat in the refrigerant that was absorbed in other portions of the refrigeration system.

Fin-and-tube condenser coils, such as those utilized in many retail store refrigeration systems, often display poor efficiencies in dissipating heat from the refrigerant passing through the coils. As a result, fin-and-tube condenser coils can be rather large for the amount of heat they can dissipate from the refrigerant. Further, the larger the condenser coil becomes, the more refrigerant used in the refrigeration system, thus effectively increasing potential damage to the environment by an accidental atmospheric release.

Usually, in large-scale retail store refrigeration systems, the single fin-and-tube condenser coil is positioned outside the retail store, such as on a rooftop, to allow heat transfer between the fin-and-tube condenser coil and the outside environment (i.e., to allow the heat in the refrigerant to dissipate into the outside environment). Further, a mechanical draft may be provided by a fan, for example, to air-cool the fin-and-tube condenser coil.

Another form of heat exchangers is the microchannel coil. Currently, the only major application of microchannel coils is in the automotive industry. In an example automotive application, microchannel coils may be used as a condenser and/or an evaporator in the air conditioning system of an automobile. A microchannel condenser coil, for example, in an automotive air conditioning system is typically located toward the front of the engine compartment, where space to mount the condenser coil is limited. Therefore, the microchannel condenser coil, which is much smaller than a conventional fin-and-tube condenser coil that would otherwise be used in the automotive air conditioning system, is a suitable fit for use in an automobile. Prior to the present invention, the microchannel condenser coil has not been used in retail store refrigeration systems, in part, because of the high costs and difficulty that would be associated with manufacturing a microchannel condenser coil large enough to accommodate the heat load of the refrigeration system.

SUMMARY OF THE INVENTION

The present invention provides, in one aspect, a condenser assembly adapted to condense a refrigerant for use in a retail store refrigeration system. The condenser assembly includes at least one microchannel condenser coil including an inlet manifold and an outlet manifold. The inlet manifold has an inlet port for receiving the refrigerant, and the outlet manifold has an outlet port for discharging the refrigerant. The condenser assembly also includes a frame supporting the condenser coil.

The present invention provides, in another aspect, a condenser assembly adapted to condense a refrigerant for use in a retail store refrigeration system. The condenser assembly includes a first microchannel condenser coil configured such that the refrigerant makes at least one pass therethrough, and a second microchannel condenser coil fluidly connected with the first microchannel condenser coil. The second microchannel condenser coil is configured such that the refrigerant makes at least one pass through the second microchannel condenser coil after making at least one pass through the first microchannel condenser coil. The condenser assembly also includes a frame supporting the first and second microchannel condenser coils.

The present invention provides, in yet another aspect, a condenser assembly adapted to condense a refrigerant for use in a retail store refrigeration system. The condenser assembly includes a first microchannel condenser coil configured such that the refrigerant makes at least one pass therethrough, and a second microchannel condenser coil configured such that the refrigerant makes at least one pass therethrough. The condenser assembly also includes an inlet header fluidly connected with the first and second microchannel condenser coils. The inlet header is configured to deliver the refrigerant to the first and second microchannel condenser coils The condenser assembly further includes an outlet header fluidly connected with the first and second microchannel condenser coils. The outlet header is configured to receive refrigerant from the first and second microchannel condenser coils. The first and second microchannel condenser coils are connected to receive and deliver refrigerant in a parallel relationship between the inlet and outlet headers. The condenser assembly also includes a frame supporting the first and second microchannel condenser coils.

The present invention provides, in a further aspect, a method of assembling a condenser assembly adapted to condense a refrigerant for use in a retail store refrigeration system. The method includes providing a first microchannel condenser coil configured such that the refrigerant makes at least one pass therethrough, fluidly connecting the first microchannel condenser coil to a second microchannel condenser coil configured such that the refrigerant makes at least one pass through the second microchannel condenser after making at least one pass through the first microchannel condenser coil, and supporting the first and second microchannel condenser coils with a frame.

The present invention provides, in another aspect, a method of assembling a condenser assembly adapted to condense a refrigerant for use in a retail store refrigeration system. The method includes providing a first microchannel condenser coil configured such that the refrigerant makes at least one pass therethrough and a second microchannel condenser coil configured such that the refrigerant makes at least one pass therethrough. The method also includes fluidly connecting an inlet header to the first and second microchannel condenser coils. The inlet header is configured to deliver the refrigerant to the first and second microchannel condenser coils. The method further includes fluidly connecting an outlet header to the first and second microchannel condenser coils. The outlet header is configured to receive the refrigerant from the first and second microchannel condenser coils. The first and second microchannel condenser coils are connected to receive and deliver refrigerant in a parallel relationship between the inlet and outlet headers. Also, the method includes supporting the first and second microchannel condenser coils with a frame.

Other features and aspects of the present invention will become apparent to those skilled in the art upon review of the following detailed description, claims and drawings.

BRIEF DESCRIPTION OF THE DRAWINGS

In the drawings, wherein like reference numerals indicate like parts.

Figure 1:
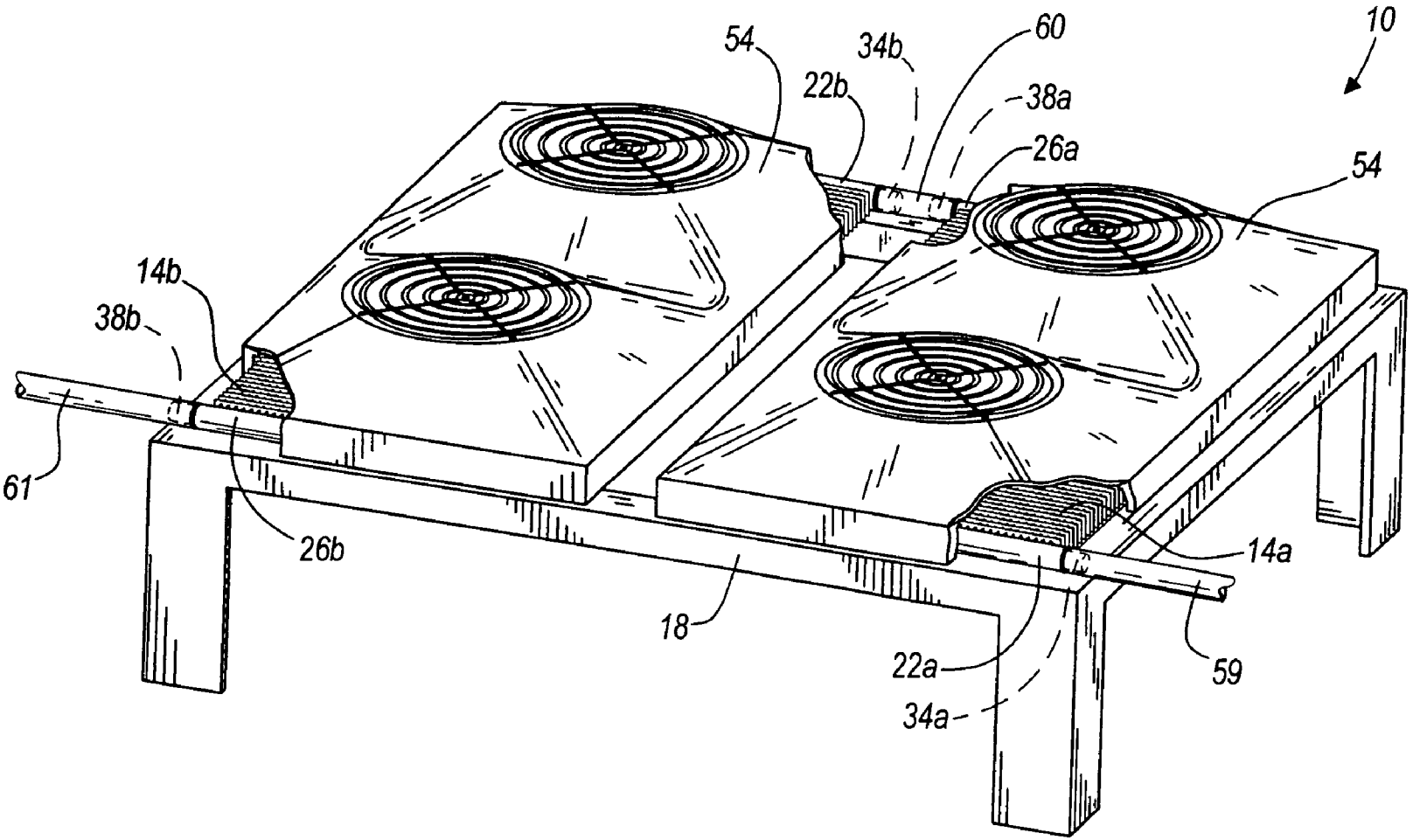
FIG. 1 is a perspective view of a first construction of a condenser assembly of the present invention.

Before any features of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limited.

DETAILED DESCRIPTION

With reference to FIG. 1, a first configuration of a condenser assembly 10 is shown. The condenser assembly 10 may be used in a large-scale retail store refrigeration system, such as that found in many large grocery stores or supermarkets. In such a refrigeration system, the condenser assembly 10 may be positioned outside the retail store, such as on the rooftop of the store, to allow heat transfer from the condenser assembly 10 to the outside environment. The role of the condenser assembly 10 in the refrigeration system is to receive compressed, gaseous refrigerant from one or more compressors (not shown), condense the gaseous refrigerant back into its liquid form, and discharge the compressed, liquid refrigerant to one or more evaporators (not shown) located inside the store. The liquid refrigerant is evaporated when it is passed through the evaporators, and the gaseous refrigerant is drawn into the one or more compressors for re-processing into the refrigeration system.

"Refrigerant-22," or "R-22," in addition to anyhydrous ammonia, for example, may be used in such a refrigeration system to provide sufficient cooling to the refrigeration system. If R-22 is used as the refrigerant of choice, the components of the refrigeration system in contact with the R-22 may be made from copper, aluminum, or steel, among other materials. However, as understood by those skilled in the art, if anyhydrous ammonia is used as the refrigerant of choice, copper components of the refrigeration system in contact with the anyhydrous ammonia may corrode. Alternatively, other refrigerants (including both two-phase and single-phase refrigerants or coolants) may be used with the condenser assembly 10.

In addition to retail store refrigeration systems, the condenser assembly 10 may also be used in various process industries, where the condenser assembly 10 may be a portion of a fluid cooling system using a single-phase coolant (e.g., glycol). In such an application, the role of the condenser assembly 10 the fluid cooling system is to receive heated liquid coolant from one or more heat sources (e.g., a pump or an engine, not shown), cool the heated liquid, and discharge the cooled liquid coolant to the one or more heat sources. The cooled liquid coolant is again heated when it is put in thermal contact with the one or more heat sources, and the heated gaseous coolant is routed by a pump or compressors for re-processing into the fluid cooling system.

In the illustrated construction of FIG. 1, the condenser assembly 10 includes two microchannel condenser coils 14*a*, 14*b* being supported by a frame 18. The frame 18 may be a freestanding structure as shown in FIG. 1. However, the frame 18 may comprise any number of different designs other than that shown in FIG. 1. As such, the illustrated frame 18 of FIG. 1 is intended for illustrative purposes only.

Figure 3A:
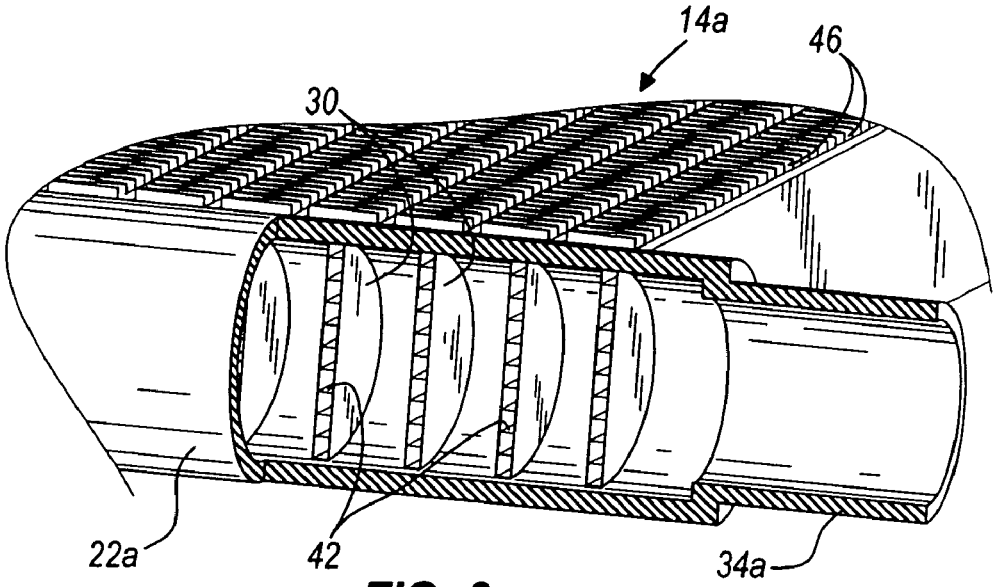
FIG. 3*a* is a partial section view of the first microchannel condenser coil of FIG. 2, exposing multiple microchannels.
Figure 3B:
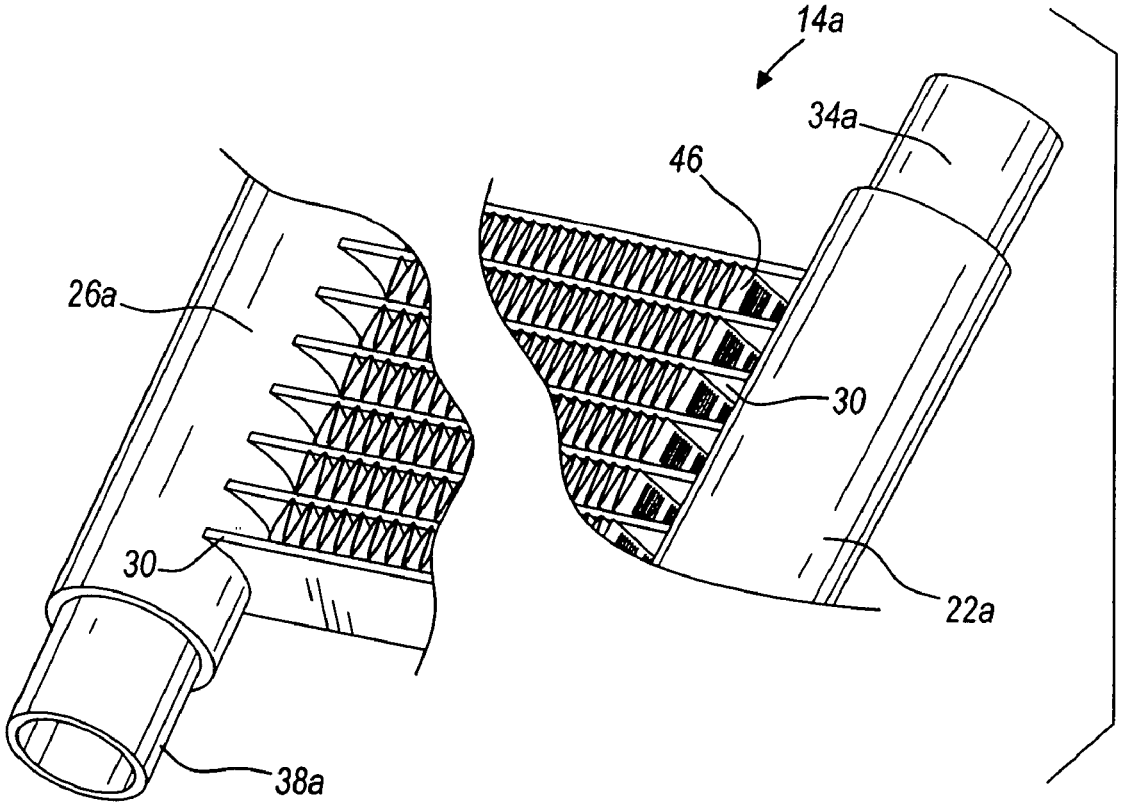
FIG. 3*b* is a broken view of the first microchannel condenser coil of FIG. 2.

As shown in FIGS. 3*a*–3*b*, each microchannel condenser coil 14*a*, 14*b* includes an inlet manifold 22*a*, 22*b* and an outlet manifold 26*a*, 26*b* fluidly connected by a plurality of flat tubes 30. The inlet manifold 22*a*, 22*b* includes an inlet port 34*a*, 34*b* for receiving refrigerant, and the outlet manifold 26*a*, 26*b* includes an outlet port 38*a*, 38*b* for discharging the refrigerant. One or more baffles (not shown) may be placed in the inlet manifold 22*a*, 22*b* and/or the outlet manifold 26*a*, 26*b* to cause the refrigerant to make multiple passes through the flat tubes 30 for enhanced cooling of the refrigerant.

The flat tubes 30 may be formed to include multiple internal passageways, or microchannels 42, that are much smaller in size than the internal passageway of the coil in a conventional fin-and-tube condenser coil. The microchannels 42 allow for more efficient heat transfer between the airflow passing over the flat tubes 30 and the refrigerant carried within the microchannels 42, compared to the airflow passing over the coil of the conventional fin-and-tube condenser coil. In the illustrated construction, the microchannels 42 each are configured with a rectangular cross-section, although other constructions of the flat tubes 30 may have passageways of other cross-sections. The flat tubes 30 are separated into about 10 to 15 microchannels 42, with each microchannel 42 being about 1.5 mm in height and about 1.5 mm in width, compared to a diameter of about 9.5 mm (⅜") to 12.7 mm (½") for the internal passageway of a coil in a conventional fin-and-tube condenser coil. However, in other constructions of the flat tubes 30, the microchannels 42 may be as small as 0.5 mm by 0.5 mm, or as large as 4 mm by 4 mm.

The flat tubes 30 may also be made from extruded aluminum to enhance the heat transfer capabilities of the flat tubes 30. In the illustrated construction, the flat tubes 30 are about 22 mm wide. However, in other constructions, the flat tubes 30 may be as wide as 26 mm, or as narrow as 18 mm. Further, the spacing between adjacent flat tubes 30 may be about 9.5 mm. However, in other constructions, the spacing between adjacent flat tubes 30 may be as much as 16 mm, or as little as 3 mm.

As shown in FIG. 3*b*, each microchannel condenser coil 14*a*, 14*b* includes a plurality of fins 46 coupled to and positioned along the flat tubes 30. The fins 46 are generally arranged in a zig-zag pattern between adjacent flat tubes 30. In the illustrated construction, the fin density mesured along the length of the flat tubes 30 is between 12 and 24 fins per inch. However, in other constructions of the microchannel condenser coils 14*a*, 14*b*, the fin density may be slightly less than 12 fins per inch or more than 24 fins per inch. Generally, the fins 46 aid in the heat transfer between the airflow passing through the microchannel condenser coils 14*a*, 14*b* and the refrigerant carried by the microchannels. The fins 46 may also include a plurality of louvers formed therein to provide additional heat transfer area. The increased efficiency of the microchannel condenser coils 14*a*, 14*b* is due in part to such a high fin density, compared to the fin density of 2 to 4 fins per inch of a conventional fin-and-tube condenser coil.

The increased efficiency of the microchannel condenser coils 14*a*, 14*b*, compared to a conventional fin-and-tube condenser coil, allows the microchannel condenser coils 14*a*, 14*b* to be physically much smaller than the fin-and-tube condenser coil. As a result, the microchannel condenser coils 14*a*, 14*b* are not nearly as tall, and are not nearly as wide as a conventional fin-and-tube condenser coil.

The microchannel condenser coils 14*a*, 14*b* are attractive for use with large-scale refrigeration systems for these and other reasons. Since the microchannel condenser coils 14*a*, 14*b* are much smaller than conventional fin-and-tube condenser coils, the microchannel condenser coils 14*a*, 14*b* may occupy less space on the rooftops of the retail stores in which they are installed. As a result, the microchannel condenser coils 14*a*, 14*b* are more aesthetically appealing from an outside perspective of the store.

Since the microchannel condenser coils 14*a*, 14*b* are much smaller than conventional fin-and-tube condenser coils, the microchannel condenser coils 14*a*, 14*b* may also contain less refrigerant compared to the conventional fin-and-tube condenser coils. Further, less refrigerant may be required to be contained within the entire refrigeration system, therefore effectively decreasing potential damage to the environment by an accidental atmospheric release. Also, as a result of being able to decrease the amount of refrigerant in the refrigeration system, the retail stores may see an energy savings, since the compressor(s) may expend less energy to compress the decreased amount of refrigerant in the refrigeration system.

Figure 2:
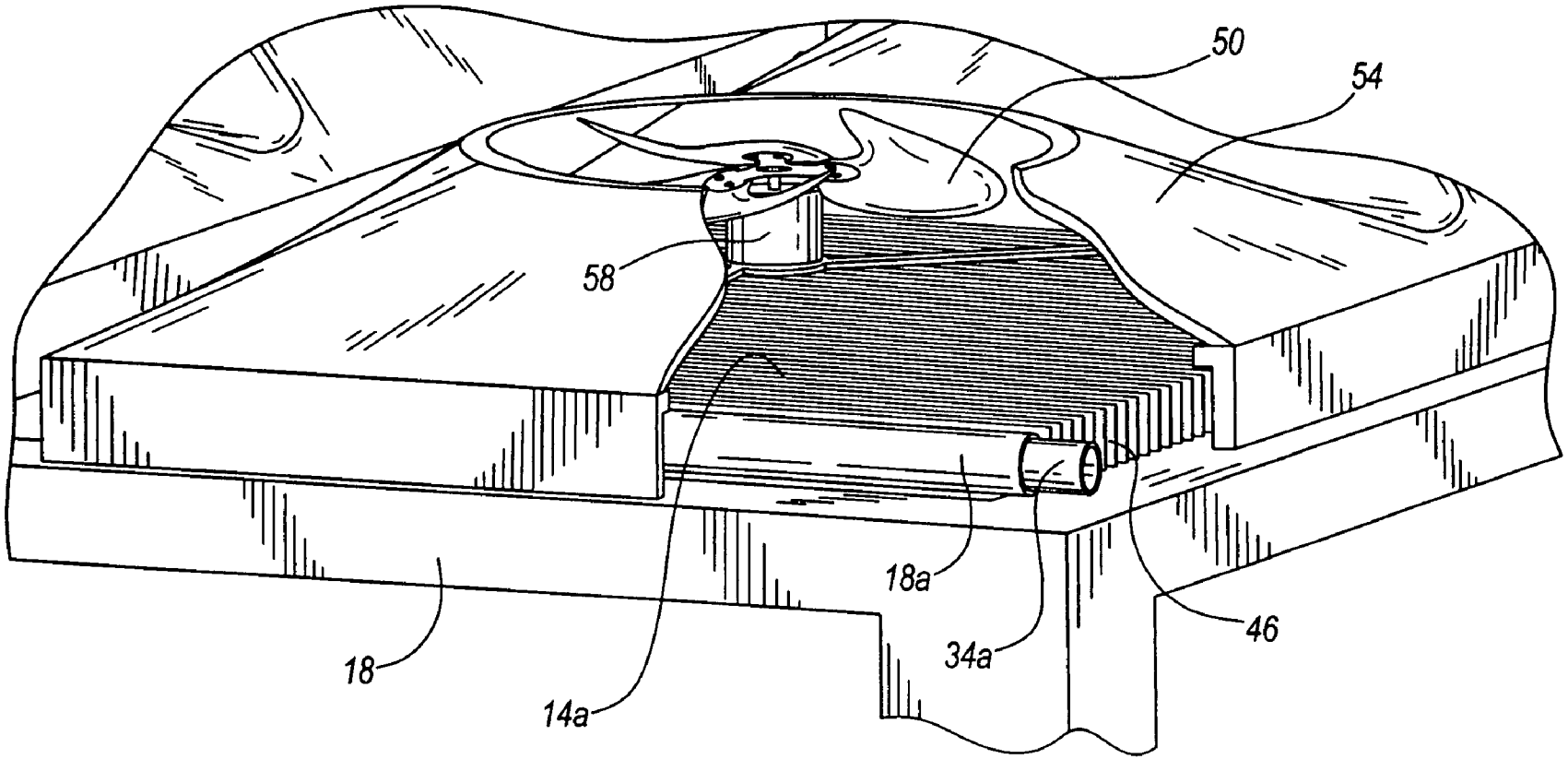
FIG. 2 is an enlarged perspective view of a first microchannel condenser coil of the condenser assembly of FIG. 1.

The condenser assembly 10 also includes fans 50 coupled to the microchannel condenser coils 14*a*, 14*b* to provide an airflow through the coils 14*a*, 14*b*. As shown in FIGS. 1 and 2, each microchannel condenser coil 14*a*, 14*b* includes two fans 50 mounted thereon. Alternatively, centrifugal blowers (not shown) may be used in place of the fans 50 or in combination with the fans 50. The fans 50 are supported in a fan shroud 54, which guides the airflow generated by the fans 50 through the microchannel condenser coils 14*a*, 14*b*, and helps distribute the airflow amongst the face of each condenser coil 14*a*, 14*b*. In a preferred construction of the condenser assembly 10, the fans 50 may be "low-noise" fans, like the SWEPTWING™ fans available from Revcor, Inc. of Carpentersville, Ill. to help decrease noise emissions from the condenser assembly 10. In other constructions of the condenser assembly 10, more or less than two fans 50 may be used for each condenser coil 14*a*, 14*b* to generate the airflow through the condenser coil 14*a*, 14*b*. Also, the fans 50 and/or the shroud 54 may comprise any number of designs different than that shown in FIGS. 1–2.

FIG. 2 illustrates the shroud 54 supporting an electric motor 58 for driving one of the fans 50. The electric motor 58 may be configured to operate using either an AC or DC power source. Further, the electric motor 58 may be electrically connected to a controller (not shown) that selectively activates the electric motor 58 to drive the fan 50 depending on any number of conditions monitored by the controller. For example, the fans 50 may be cycled on and off to either increase or decrease the heat transfer capability of the condenser coils 14*a*, 14*b*. In one manner of operating the fans 50, the fans 50 may be turned off during the nighttime, when the ambient temperature around the condenser assembly 10 is typically less than during the daytime. In another manner of operating the fans 50, the controller may receive a signal from a pressure sensor that is in communication with one or both of the condenser coils 14*a*, 14*b* that is proportional to the pressure in the coils 14*a*, 14*b*. A measured pressure greater than some pre-determined threshold pressure may trigger the controller to activate the electric motors 58 to drive the fans 50 to provide additional heat transfer capability to the coils 14*a*, 14*b*. Likewise, a measured pressure less than some pre-determined threshold pressure may trigger the controller to deactivate the electric motors 58 to stop the fans 50.

FIG. 1 illustrates two microchannel condenser coils 14*a*, 14*b* fluidly connected with the refrigeration system in a series arrangement. The inlet port 34*a* of a first microchannel condenser coil 14*a* is shown coupled to an inlet header 59, whereby compressed, gaseous refrigerant is pumped to the first microchannel condenser coil 14*a* via the inlet header 59. In the illustrated construction, the inlet header 59 is coupled to the inlet port 34*a* by a brazing or welding process. Such a brazing or welding process provides a substantially fluid-tight connection between the inlet header 59 and the inlet port 34*a*. However, other constructions of the condenser assembly 10 may utilize some sort of fluid-tight releasable couplings to allow serviceability of the coils 14*a*, 14*b*.

The outlet port 38*a* of the first microchannel condenser coil 14*a* is shown coupled to an inlet port 34*b* of a second microchannel condenser coil 14*b* via a connecting conduit 60. In the illustrated construction, the outlet port 38*a* of the first microchannel condenser coil 14*a* is coupled to the connecting conduit 60 by a brazing or welding process, and the inlet port 34*b* of the second microchannel condenser coil 14*b* is also coupled the connecting conduit 60 by a brazing or welding process. As previously stated, such a brazing or welding process provides a substantially fluid-tight connection between the outlet port 38*a* of the first microchannel condenser coil 14*a* and the inlet port 34*b* of the second microchannel condenser coil 14*b*. However, other constructions of the condenser assembly 10 may utilize some sort of permanent or releasable fluid-tight couplings.

The outlet port 38*b* of the second microchannel condenser coil 14*b* is shown coupled to an outlet header 61, whereby compressed, substantially liquefied refrigerant is discharged from the second microchannel condenser coil 14*b* to the outlet header 61 for transporting the liquid refrigerant to a receiver (not shown) or other component in the refrigeration system. Further, in the illustrated construction, the outlet port 38*b* of the second microchannel condenser coil 14*b* is coupled to the outlet header 61 by a brazing or welding process to provide a substantially fluid-tight connection between the outlet port 38*b* of the second microchannel condenser coil 14*b* and the outlet header 61. However, other constructions of the condenser assembly 10 may utilize some sort of permanent or releasable fluid-tight couplings.

During operation of the refrigeration system utilizing the condenser assembly 10 of FIG. 1, the compressed, gaseous refrigerant is pumped into the first microchannel condenser coil 14*a*, where the heat transfer between the airflow passing through the condenser coil 14*a* and the refrigerant causes the gaseous refrigerant to at least partially condense as the refrigerant passes through the flat tubes 30. If baffles are not placed in either of the inlet or outlet manifolds 22*a*, 26*a* of the first microchannel condenser coil 14*a*, the refrigerant will make one pass from the inlet manifold 22*a* to the outlet manifold 26*a* before being discharged from the first microchannel condenser coil 14*a*. Further, the fans 50 may be activated to provide and/or enhance the airflow through the first microchannel condenser coil 14*a* to further enhance cooling of the refrigerant.

Since the condenser coils 14*a*, 14*b* are connected in a series arrangement, the refrigerant is passed from the first microchannel condenser coil 14*a* to the second microchannel condenser coil 14*b*. If only a portion of the compressed, gaseous refrigerant is condensed in the first microchannel condenser coil 14*a*, then the remaining portion is condensed in the second microchannel condenser coil 14*b*. Like the first microchannel condenser coil 14*a*, if baffles are not placed in either of the inlet or outlet manifolds 22*b*, 26*b* of the second microchannel condenser coil 14*b*, the refrigerant will make one pass from the inlet manifold 22*b* to the outlet manifold 26*b* before being discharged from the second microchannel condenser coil 14*b*. Further, the fans 50 may be activated to provide and/or enhance the airflow through the second microchannel condenser coil 14*b* to further enhance cooling of the refrigerant.

Figure 4:
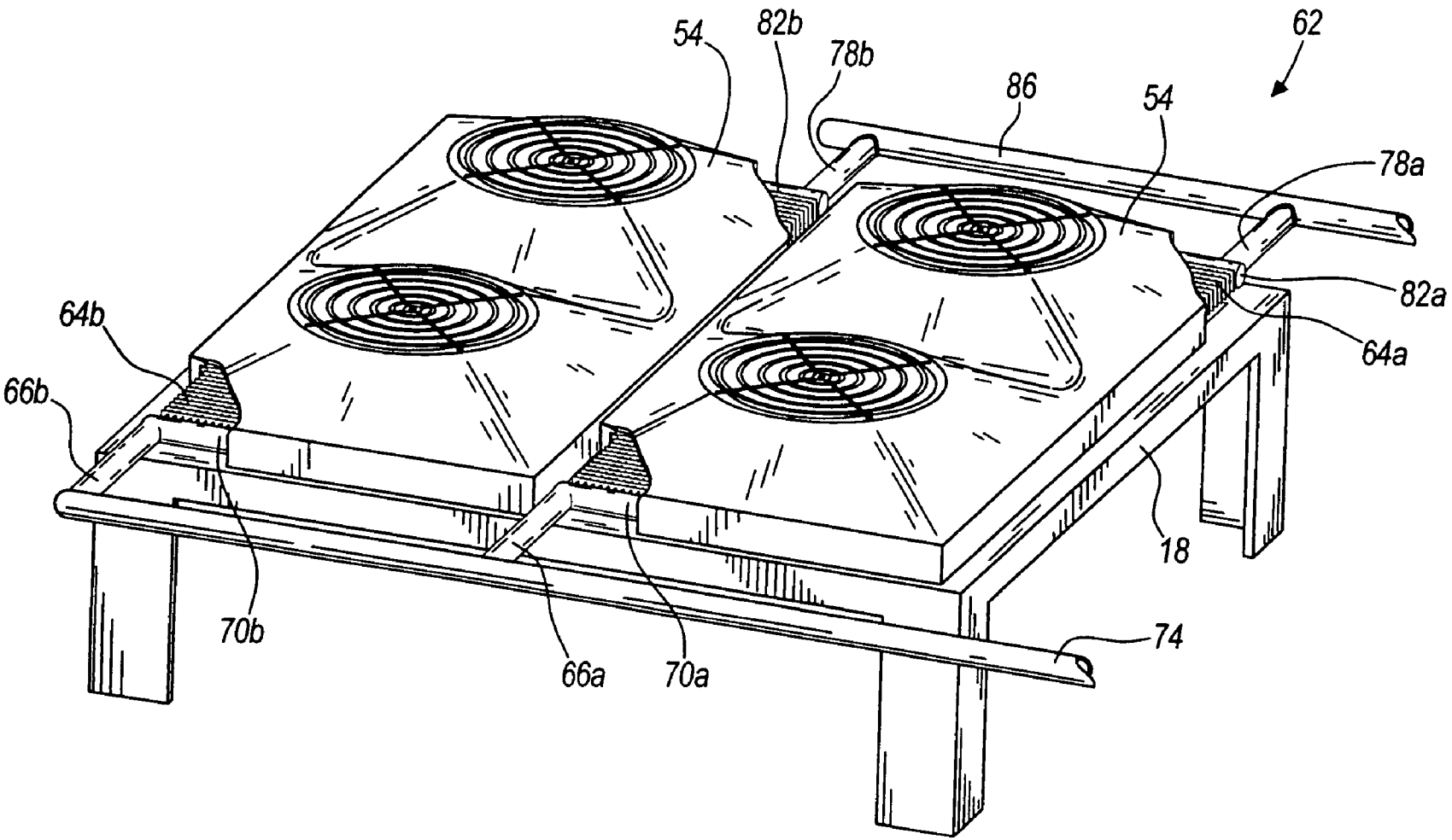
FIG. 4 is a perspective view of a second construction of a condenser assembly of the present invention.

FIG. 4 illustrates a condenser assembly 62 having two microchannel condenser coils 64*a*, 64*b* fluidly connected with the refrigeration system in a parallel arrangement. The frame 18 illustrated in FIG. 4 is substantially the same as that shown in FIG. 1, the particular design of which is for illustrative purposes only and will not be further discussed. The fans 50 and the fan shrouds 54 are also substantially the same as that shown in FIG. 1, and will not be further discussed. Inlet ports 66*a*, 66*b* of the first and second microchannel condenser coils 64*a*, 64*b* are shown extending from inlet manifolds 70*a*, 70*b* and coupled to an inlet header 74, whereby compressed, gaseous refrigerant is pumped to the first and second microchannel condenser coils 64*a*, 64*b* via the inlet header 74. In the illustrated construction, the inlet header 74 is coupled to the inlet ports 66*a*, 66*b* of the first and second microchannel condenser coils 64*a*, 64*b* by a brazing or welding process to provide a substantially fluid-tight connection between the inlet header 74 and the inlet ports 66*a*, 66*b*. However, other constructions of the condenser assembly 62 may utilize some sort of permanent or releasable fluid-tight couplings.

In addition, "orifice buttoning" may be used in the condenser assembly 62 to facilitate a substantially equal distribution of refrigerant to the coils 64*a*, 64*b* along the inlet header 74. This may be accomplished by varying the flow space through the inlet ports 66*a*, 66*b* of the coils 64*a*, 64*b*. In the illustrated construction of FIG. 4, coil 64*b* is located downstream of coil 64*a*. Furthermore, to maintain a substantially similar flow rate of refrigerant through both of the coils 64*a*, 64*b*, the inlet port 66*a* of coil 64*a* may be smaller than the inlet port 66*b* of coil 64*b* to accommodate for the pressure drop between the coils 64*a*, 64*b*. However, in other constructions of the condenser assembly 62, other restricting devices (not shown) may be positioned in the inlet ports 66*a*, 66*b* to provide a varying flow space rather than varying the size of the inlet ports 66*a*, 66*b*.

Outlet ports 78*a*, 78*b* of the first and second microchannel condenser coils 64*a*, 64*b* are shown extending from outlet manifolds 82*a*, 82*b* coupled to an outlet header 86, whereby compressed, liquid refrigerant is discharged from the first and second microchannel condenser coils 64*a*, 64*b* via the outlet header 86. In the illustrated construction, the outlet header 86 is coupled to the outlet ports 78*a*, 78*b* of the first and second microchannel condenser coils 64*a*, 64*b* by a brazing or welding process to provide a substantially fluid-tight connection between the outlet header 86 and the outlet ports 78*a*, 78*b*. However, other constructions of the condenser assembly 62 may utilize some sort of permanent or releasable fluid-tight couplings.

Figure 10:
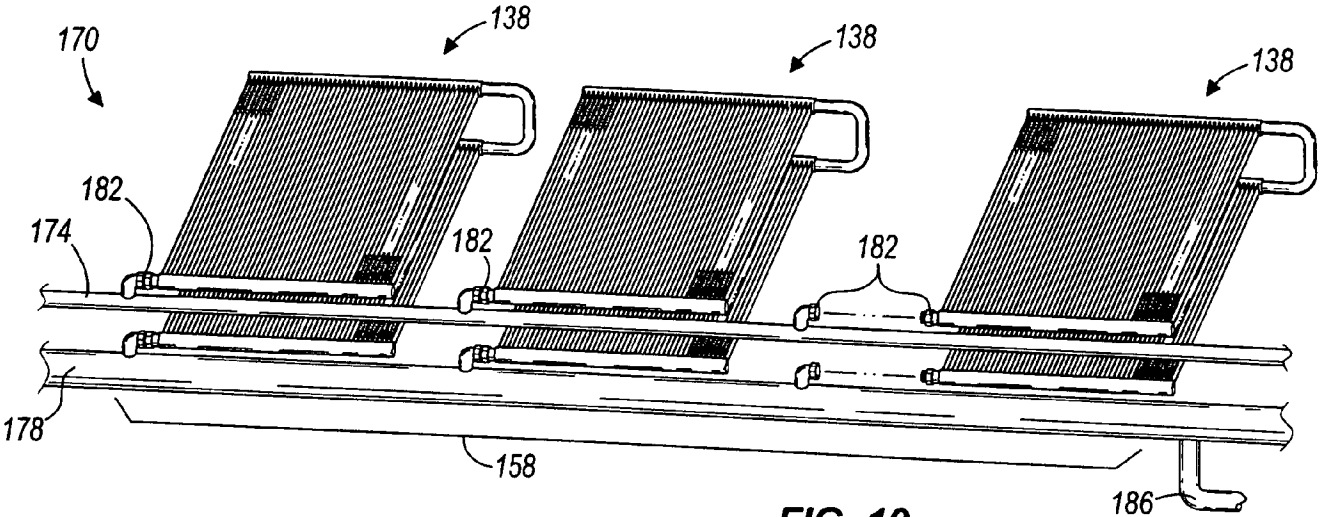
FIG. 10 is a perspective view of a third construction of a condenser assembly of the present invention.

In some constructions of the condenser assembly 62, the outlet header 86 may be configured to be used as a receiver for the liquid refrigerant condensed by the microchannel condenser coils 64*a*, 64*b* (see FIG. 10). The receiver is typically sized to be able to hold all of the refrigerant in the system in a condensed form. One or more liquid refrigerant lines may therefore fluidly connect the receiver and the one or more evaporators in the refrigeration system. By configuring the outlet header 86 to also act as the liquid refrigerant receiver, a dedicated separate receiver tank (not shown) is not required in the refrigeration system. This allows a sizable component, in addition to the piping associated therewith, to be eliminated from the refrigeration system. Additional benefits such as those outlined above may be realized by reducing the amount of refrigerant in the refrigeration system.

Also, in the illustrated construction, the inlet ports 66*a*, 66*b* extend substantially transversely from the inlet manifolds 70*a*, 70*b*, and the outlet ports 78*a*, 78*b* extend substantially transversely from the outlet manifolds 82*a*, 82*b* to fluidly connect with the inlet and outlet headers 74, 86. However, in other constructions of the condenser assembly 62, the inlet ports 66*a*, 66*b* and the outlet ports 78*a*, 78*b* may extend from the respective inlet manifolds 70*a*, 70*b* and the outlet manifolds 82*a*, 82*b* as shown in FIG. 1, and utilize additional intermediate piping to fluidly connect the inlet ports 66*a*, 66*b* with the inlet header 74 and the outlet ports 78*a*, 78*b* with the outlet header 86.

During operation of the refrigeration system utilizing the condenser assembly 62 of FIG. 4, the compressed, gaseous refrigerant is pumped through the inlet header 74, where the some of the gaseous refrigerant enters the first microchannel condenser coil 64*a* and the remaining gaseous refrigerant enters the second microchannel condenser coil 64*b*. Heat transfer between the airflow passing through the condenser coils 64*a*, 64*b* and the refrigerant causes the gaseous refrigerant to condense as the refrigerant passes through the flat tubes 30. If baffles are not placed in either of the inlet manifold 70*a* or the outlet manifold 82*a* of the first microchannel condenser coil 64*a*, the refrigerant will make one pass from the inlet manifold 70*a* to the outlet manifold 82*a* before being discharged from the first microchannel condenser coil 64*a* to the outlet header 86. Further, the fans 50 may be activated to provide and/or enhance the airflow through the first microchannel condenser coil 64*a* to further enhance cooling of the refrigerant.

Since the condenser coils 64*a*, 64*b* are connected with the refrigeration system in a parallel arrangement, and if baffles are not placed in either of the inlet manifold 70*b* or the outlet manifold 82*b* of the second microchannel condenser coil 64*b*, the refrigerant will make one pass from the inlet manifold 70*b* to the outlet manifold 82*b* before being discharged from the second microchannel condenser coil 64*b* to the outlet header 86, where the liquid refrigerant rejoins the liquid refrigerant discharged by the first microchannel condenser coil 64*a*. Further, the fans 50 may be activated to provide and/or enhance the airflow through the second microchannel condenser coil 64*b* to further enhance cooling of the refrigerant.

Each microchannel condenser coil 64*a*, 64*b* may also include multiple inlet and outlet ports (not shown), corresponding with multiple baffles (not shown) located within the inlet manifolds 70*a*, 70*b* and/or the outlet manifolds 82*a*, 82*b* to provide multiple cooling circuits throughout each microchannel condenser coil 64*a*, 64*b*.

Figure 5:
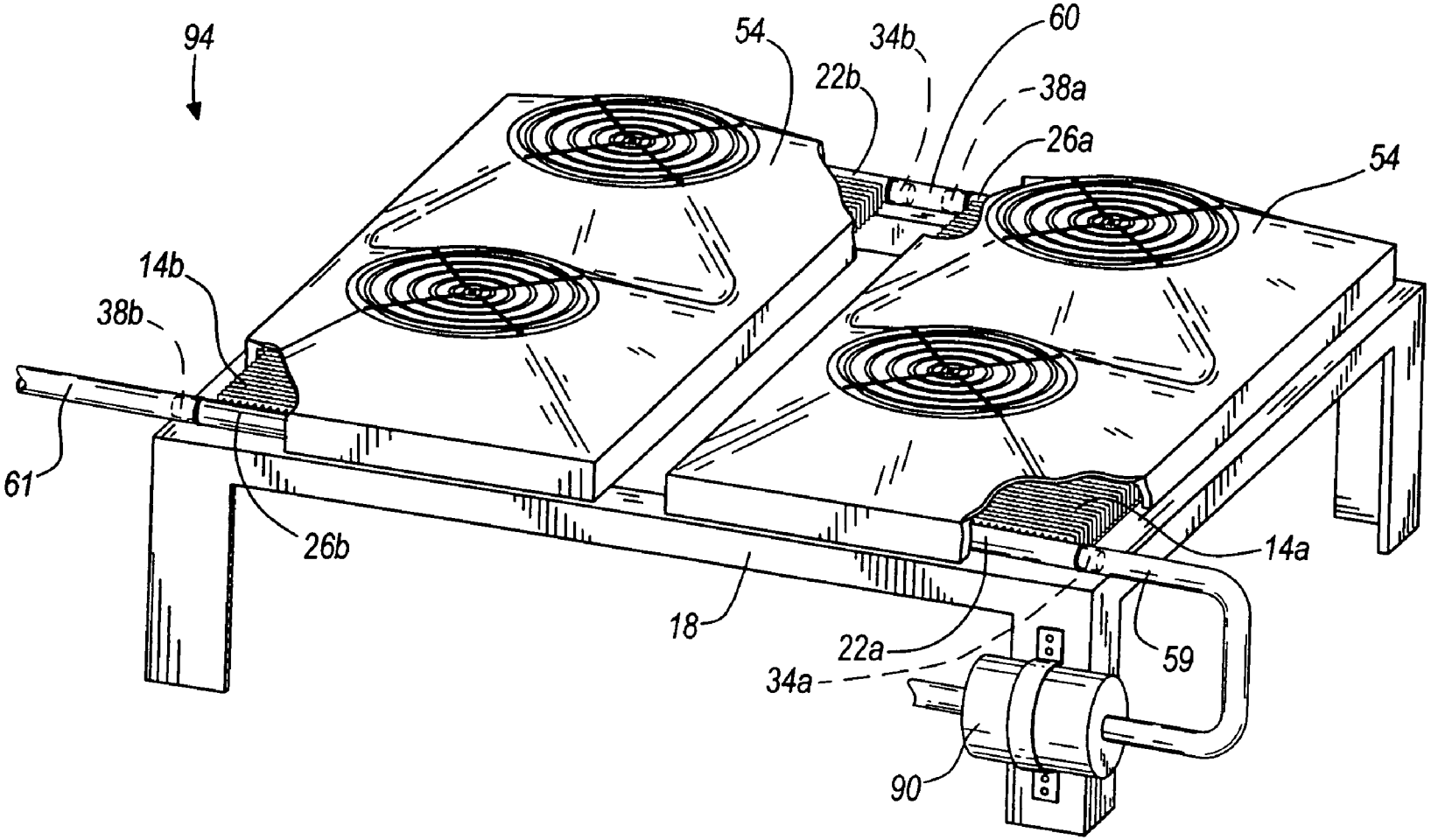
FIG. 5 is a perspective view of a condensing unit including the condenser assembly of FIG. 1 and a compressor.

The condenser assembly 10 or 62 may also include a compressor 90 coupled thereto to yield a condenser unit 94 (see FIG. 5). The compressor 90 may be coupled to the frame 18 of the condenser assembly 10 or 62 by any of a number of conventional methods, and may be fluidly connected with the microchannel condenser coils 14*a*, 14*b*, 64*a*, 64*b* to provide the compressed, gaseous refrigerant to the coils 14*a*, 14*b*, 64*a*, 64*b*. Conventionally, the compressor is located in a machine room separate from the retail area of the retail store. The compressor in the machine room is typically remotely located from the rest of the components in the refrigeration system, including the evaporators, which are typically located within refrigerated merchandisers (not shown) in the retail area of the store, and the condensers, which are typically located on the rooftop of the retail store. By placing the compressor 90 with the condenser assembly 10 or 62, the amount of piping and conduit required to fluidly connect the compressor 90 with the microchannel condenser coils 14*a*, 14*b*, 64*a*, 64*b* may be decreased. Subsequently, the amount of refrigerant that is carried in the system may also be decreased.

The microchannel condenser coils 14*a*, 14*b*, 64*a*, 64*b* allow for a unique method of assembling the condenser assemblies 10, 62. As previously stated, a single, large conventional fin-and-tube condenser coil is typically provided in a retail store refrigeration system to condense all of the refrigerant in the refrigeration system. This conventional fin-and-tube condenser coil must be appropriately sized to accommodate the heat load of the refrigeration system. In other words, the conventional fin-and-tube condenser coil must be large enough to dissipate the heat in the gaseous refrigerant for the entire system. Such a condenser coil must often be custom manufactured to the size required by the refrigeration system. Further, the frame and fan shrouds may also require custom manufacturing to match up with the custom manufactured conventional fin and tube condenser coil. This may drive up the costs associated with manufacturing a condenser assembly utilizing a conventional fin-and-tube condenser coil.

The microchannel condenser coils 14*a*, 14*b*, 64*a*, 64*b* are manufactured in standard sizes, which allows the manufacturer of the condenser assembly 10 or 62 to utilize their expertise to calculate the total heat load of a particular refrigeration system and determine how many standard-sized microchannel condenser coils 14*a*, 14*b* or 64*a*, 64*b* will be required to satisfy the total heat load of the refrigeration system. After determining how many standard-sized microchannel condenser coils 14*a*, 14*b* or 64*a*, 64*b* will be required, the manufacturer may utilize their capabilities to put together the condenser assembly 10 or 62. Fluid connections may be made by brazing or welding processes, or releasable couplings may be used to allow serviceability of the coils 14*a*, 14*b* or 64*a*, 64*b*. Further, the fans 50 and the fan shrouds 54 may be manufactured or purchased by the condenser assembly manufacturer in standard sizes to match up with the standard-sized microchannel condenser coils 14*a*, 14*b*, 64*a*, 64*b*. Also, the frame 18 may be either custom made to support multiple connected microchannel condenser coils 14*a*, 14*b* or 64*a*, 64*b*, or the frame 18 may be standard-sized to support a single or dual microchannel condenser coils 14*a*, 14*b* or 64*a*, 64*b*, for example. This method of assembling the condenser assemblies 10, 62 may allow the manufacturer to streamline their operation, which in turn may result in decreased costs for the manufacturer.

Although only two microchannel condenser coils 14*a*, 14*b* or 64*a*, 64*b* are shown in the illustrated constructions of FIGS. 1 and 4, more or less than two microchannel condenser coils 14*a*, 14*b* or 64*a*, 64*b* may be included in the condenser assemblies 10 or 62 to satisfy the total heat load of the refrigeration system in which the microchannel condenser coils 14*a*, 14*b* or 64*a*, 64*b* will be used.

Figure 6B:
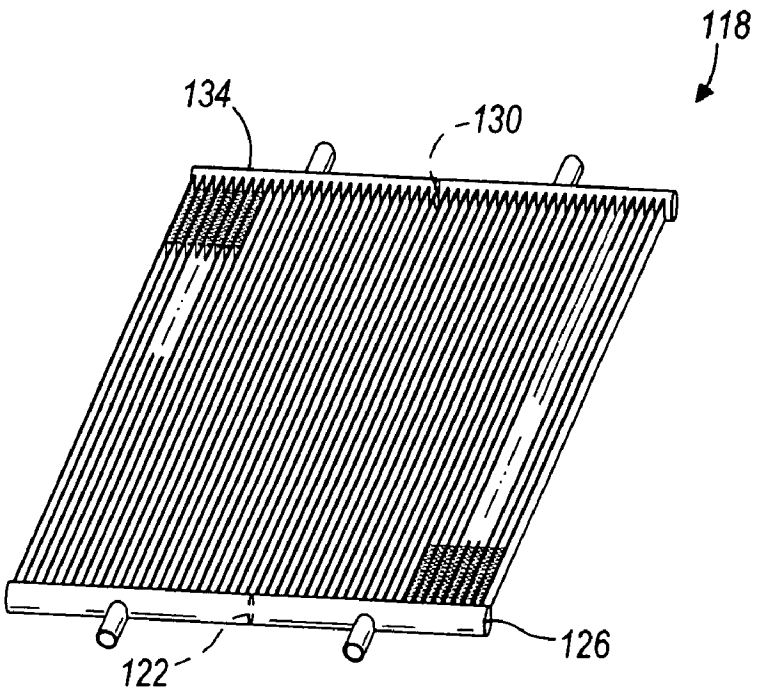
FIG. 6*b* is a perspective view of a third microchannel condenser coil that may be utilized in a condenser assembly of the present invention.
Figure 6A:
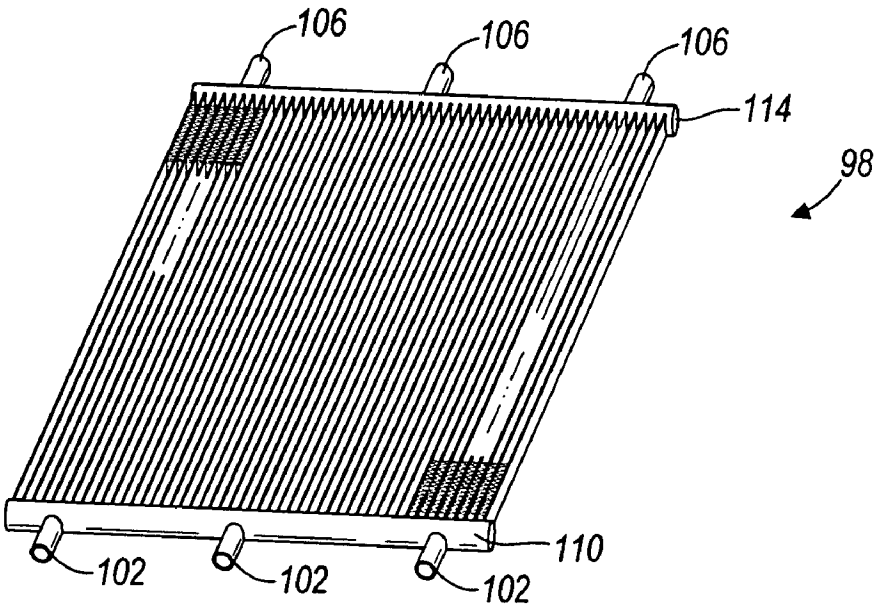
FIG. 6*a* is a perspective view of a second microchannel condenser coil that may be utilized in a condenser assembly of the present invention.

With reference to FIGS. 6*a* and 6*b*, other condenser coils may be utilized in the condenser assemblies 10, 62. FIG. 6*a* illustrates a microchannel condenser coil 98 substantially similar to the coils 14*a*, 14*b*, 64*a*, 64*b* with the exception that the coil 98 includes multiple inlet ports 102 and outlet ports 106. This style of microchannel condenser coil 98 may provide a better distribution of vaporized refrigerant to an inlet manifold 110 of the coil 98, in addition to a better distribution of liquid refrigerant from an outlet manifold 114 of the coil 98.

FIG. 6*b* illustrates another microchannel condenser coil 118 substantially similar to the coils 14*a*, 14*b*, 64*a*, 64*b*, 98 with the exception that the coil 118 is divided into two separate and distinct fluid circuits by a baffle 122 positioned in an inlet manifold 126 of the coil 118 and another baffle 130 positioned in an outlet manifold 134 of the coil 118. This style of microchannel condenser coil 118 may allow refrigerant from multiple refrigeration circuits (corresponding with multiple refrigeration display cases) to be passed through the coil 118. As a result, benefits such as a reduction in the number of separate and dedicated condenser coils for each refrigeration circuit may be achieved by using the coil 118 of FIG. 6*b*. Subsequently, the amount of refrigerant that is carried in each refrigeration circuit may also be reduced.

Figure 7B:
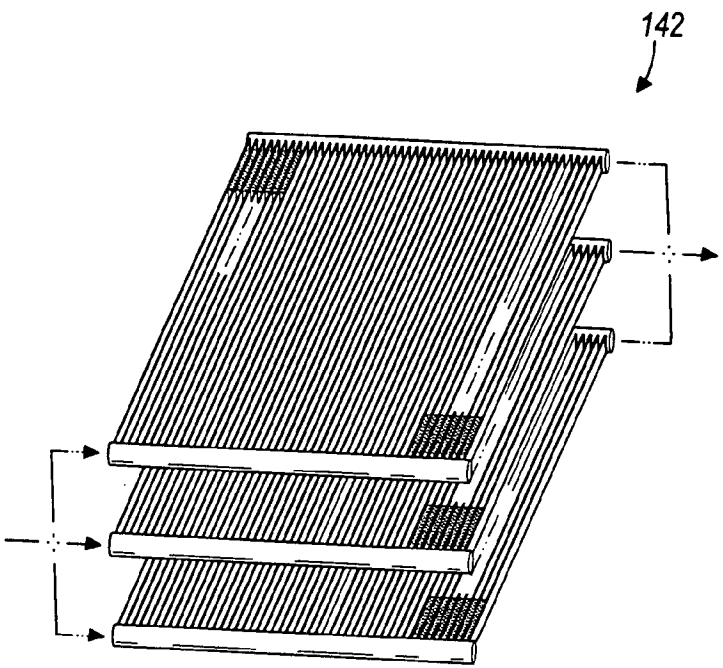
FIG. 7*b* is a schematic view of multiple microchannel condenser coils arranged as a multiple row assembly, illustrating the multiple coils in a parallel arrangement.
Figure 7A:
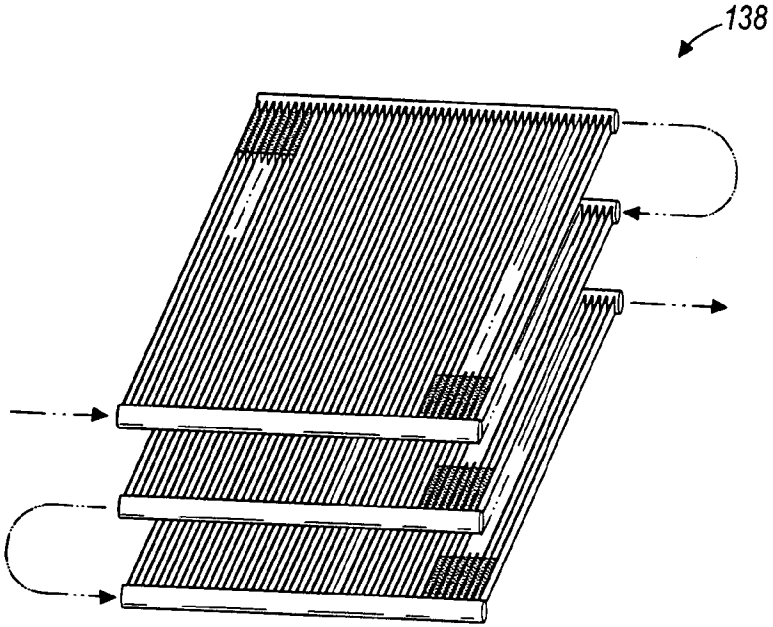
FIG. 7*a* is a schematic view of multiple microchannel condenser coils arranged as a multiple row assembly, illustrating the multiple coils in a series arrangement.

With reference to FIGS. 7*a*–8*b*, any of the microchannel condenser coils 14*a*, 14*b*, 64*a*, 64*b*, 98, or 118 may be grouped together in either single-row assemblies or multiple-row assemblies. FIGS. 7*a* and 7*b* illustrate coils being grouped in multiple-row assemblies 138, 142, respectively. Specifically, FIGS. 7*a* and 7*b* illustrate coils being grouped in three-row assemblies 138, 142. In the three-row assemblies 138, 142 of FIGS. 7*a* and 7*b*, the coils are stacked one on top of another such that airflow is directed through all of the coils. Although three coils are shown in the multiple-row assemblies 138, 142 of FIGS. 7*a* and 7*b*, more or less than three coils 14*a*, 14*b*, 64*a*, 64*b*, 98, or 118 may be used depending on the total heat load of a particular refrigeration system in which the assemblies 138, 142 are used. In addition, although FIGS. 7*a* and 7*b* generally illustrate the coils 14*a*, 14*b*, it should be known that any of the coils 14*a*, 14*b*, 64*a*, 64*b*, 98, or 118 may be used in forming the assemblies 138, 142.

With particular reference to FIG. 7*a*, the three coils in the assembly 138 are shown in a fluid series connection, whereby refrigerant is passed through the three coils one after another. However, with particular reference to FIG. 7*b*, the three coils in the assembly 142 are shown in a fluid parallel connection, whereby refrigerant is passed through the coils independently of one another. In constructing the condenser assemblies 10, 62, it is up to the manufacturer to determine if multiple-row assemblies 138, 142 will be used. Furthermore, if multiple-row assemblies 138, 142 are to be used, it is up to the manufacturer to determine whether to use an assembly 138 having coils grouped in a fluid series connection, or an assembly 142 having coils grouped in a fluid parallel connection.

Figure 8A:
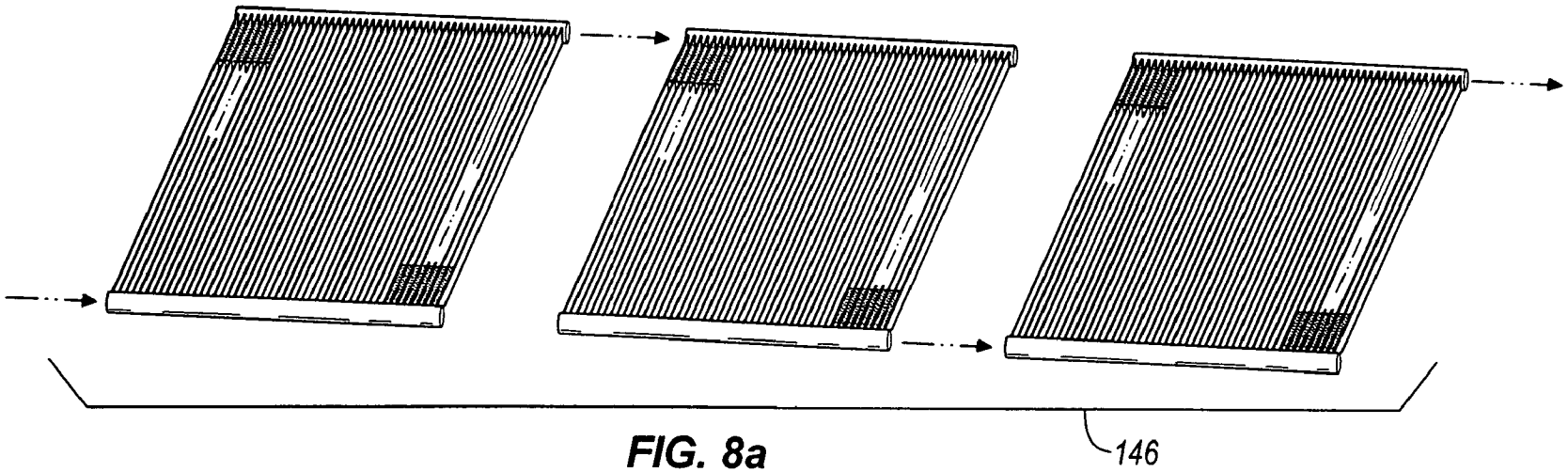
FIG. 8*a* is a schematic view of multiple microchannel condenser coils arranged in a single row assembly, illustrating the multiple coils in a series arrangement.
Figure 8B:
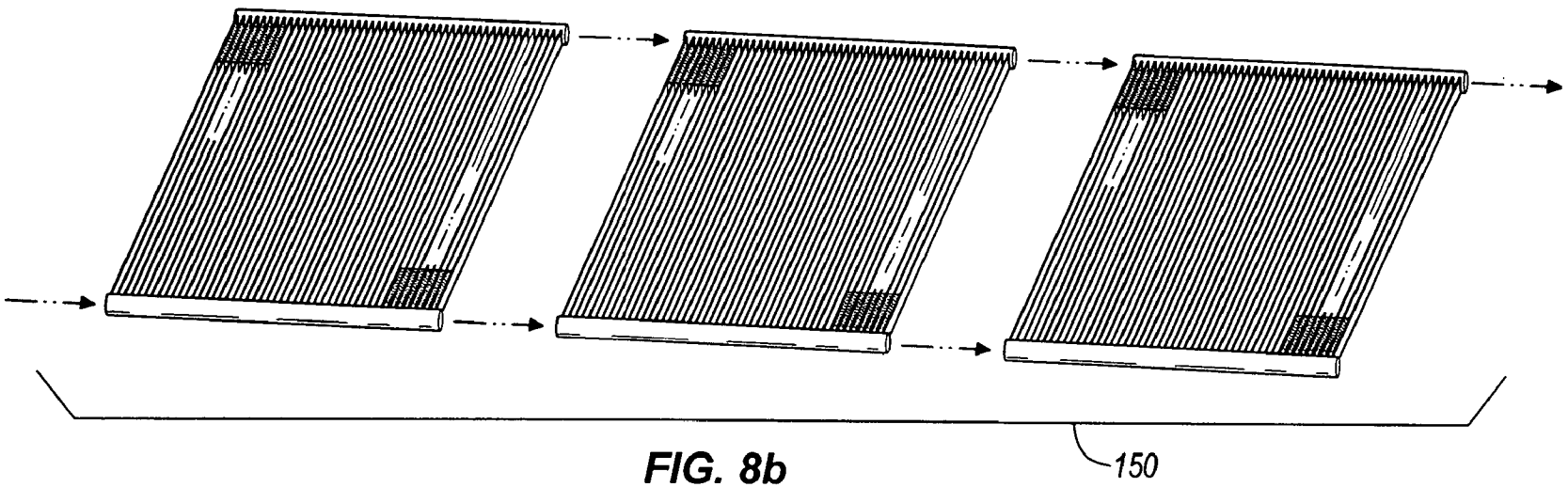
FIG. 8*b* is a schematic view of multiple microchannel condenser coils arranged in a single row assembly, illustrating the multiple coils in a parallel arrangement.

FIGS. 8*a* and 8*b* illustrate coils being grouped in single-row assemblies 146, 150. Specifically, FIGS. 8*a* and 8*b* illustrate the coils being grouped in a single-row assembly 146 of three coils. In the single-row assemblies 146, 150 of FIGS. 8*a* and 8*b*, the coils are unfolded, or spread out such that airflow passing through one of the coils is not directed through another of the three coils. Although three coils are shown in the single-row assemblies 146, 150 of FIGS. 8*a* and 8*b*, more or less than three coils may be used depending on the total heat load of the particular refrigeration system in which the assemblies 146, 150 are used. In addition, although FIGS. 8*a* and 8*b* generally illustrate the coils 14*a*, 14*b*, it should be known that any of the coils 14*a*, 14*b*, 64*a*, 64*b*, 98, or 118 may be used in forming the assemblies 146, 150.

With particular reference to FIG. 8*a*, the three coils in the assembly 146 are shown in a fluid series connection, whereby refrigerant is passed through the three coils one after another. However, with particular reference to FIG. 8*b*, the three coils in the assembly 150 are shown in a fluid parallel connection, whereby refrigerant is passed through the coils independently of one another. In constructing the condenser assemblies 10, 62, it is up to the manufacturer to determine if single-row assemblies 146, 150 will be used. Furthermore, if single-row assemblies 146, 150 are to be used, it is up to the manufacturer to determine whether to use an assembly 146 having coils grouped in a fluid series connection, or an assembly 150 having coils grouped in a fluid parallel connection.

Figure 9A:
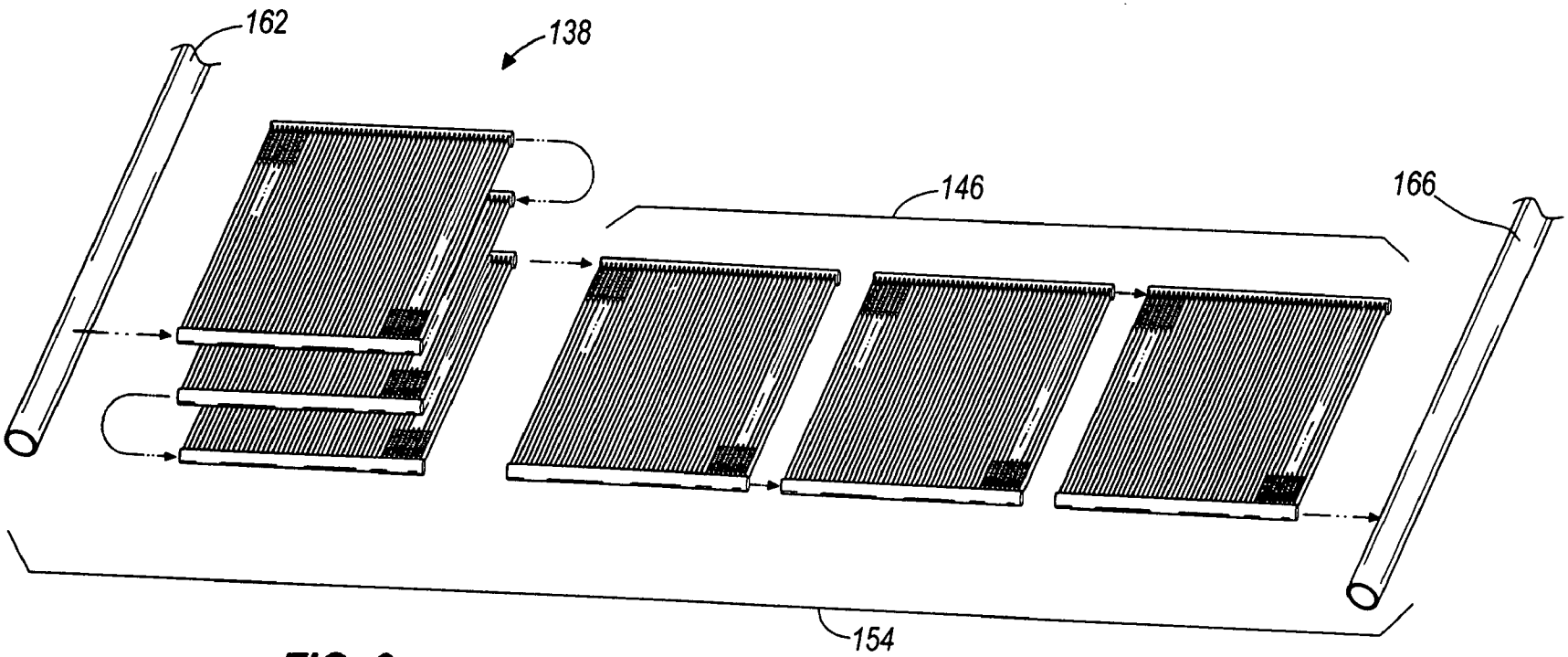
FIG. 9*a* is a schematic view of multiple coil assemblies in a series configuration with an inlet header and an outlet header.
Figure 9B:
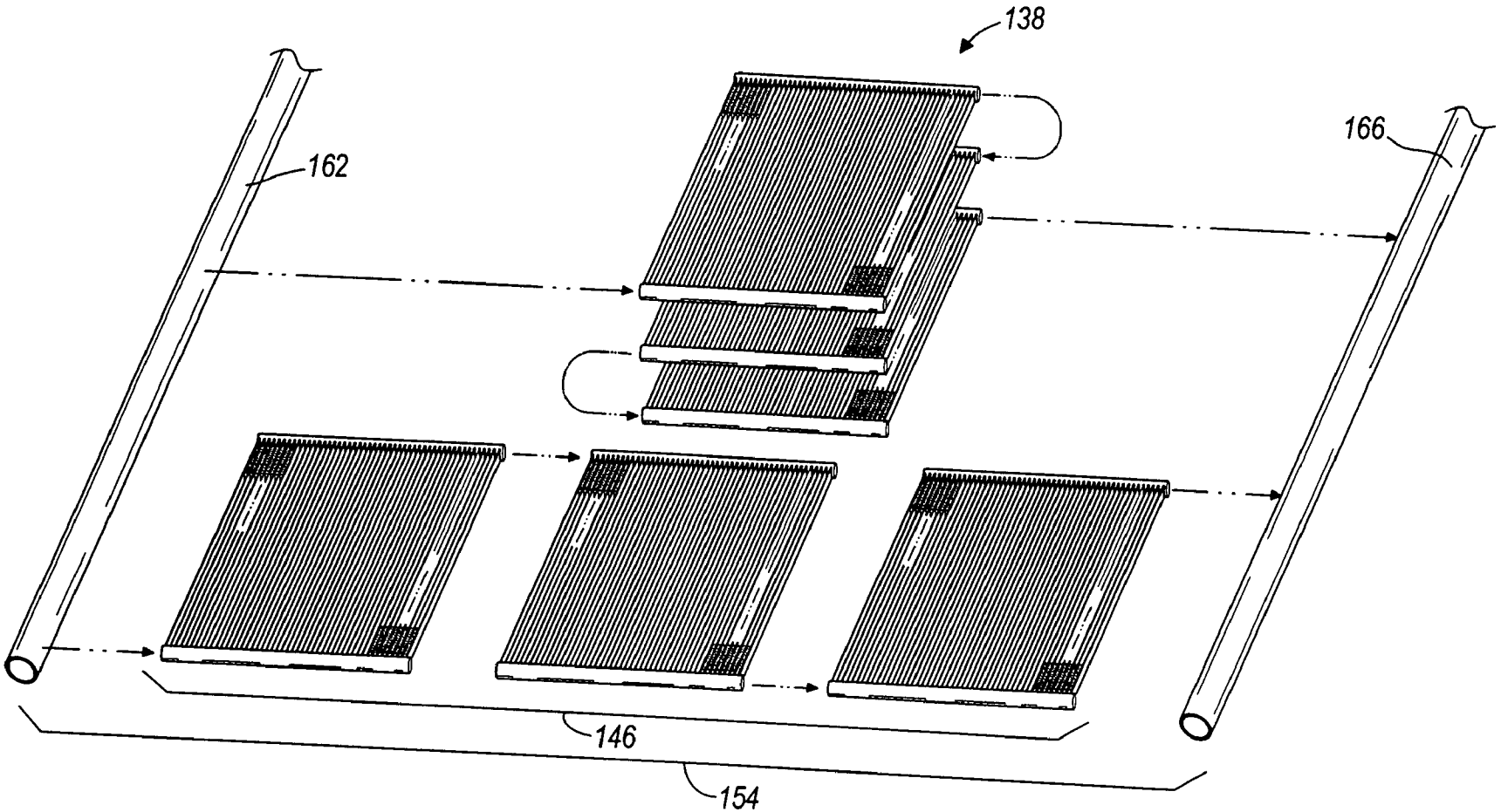
FIG. 9*b* is a schematic view of multiple coil assemblies in a parallel configuration with an inlet header and an outlet header.

With reference to FIGS. 9*a*–9*b*, one or more assemblies 138, 142, 146, or 150 may be grouped into a series configuration 154 or a parallel configuration 158 with an inlet header 162 and an outlet header 166. As shown in FIG. 9*a*, a three-row assembly 138 and a single row assembly 146 are grouped into a fluid series configuration 154 between the inlet header 162 and the outlet header 166. Although the three-row assembly 138 and single-row assembly 146 are shown in the series configuration 154 of FIG. 9*a*, any combination of multiple-row assemblies 138 or 142 and single-row assemblies 146 or 150 may be used depending on the determination of the manufacturer. In addition, more or less than two assemblies 138, 142, 146, or 150 may be used in the series configuration 154 depending on the total heat load of the particular refrigeration system in which the series configuration 154 is used. In addition, although FIG. 9*a* generally illustrates the coils 14*a*, 14*b*, it should be known that any of the coils 14*a*, 14*b*, 64*a*, 64*b*, 98, or 118 may be used in forming the assemblies 138, 142, 146, or 150 that comprise either the series configuration 154 or the parallel configuration 158.

As shown in FIG. 9*b*, a three-row assembly 138 and a single row assembly 146 are grouped into a fluid parallel configuration 158 between the inlet header 162 and the outlet header 166. Although the three-row assembly 138 and the single-row assembly 146 are shown in the parallel configuration 158 of FIG. 9*b*, any combination of multiple-row assemblies 138 or 142 and single-row assemblies 146 or 150 may be used depending on the determination of the manufacturer. In addition, more or less than two assemblies 138, 142, 146, or 150 may be used in the parallel configuration 158 depending on the total heat load of the particular refrigeration system in which the parallel configuration 158 is used. In addition, although FIG. 9*a* generally illustrates the coils 14*a*, 14*b*, it should be known that any of the coils 14*a*, 14*b*, 64*a*, 64*b*, 98, or 118 may be used in forming the assemblies 138, 142, 146, or 150 that comprise either the series configuration 154 or the parallel configuration 158. Further, one or more baffles (not shown) may be positioned in the inlet and outlet headers 162, 166 between adjacent assemblies 138, 142, 146, or 150 to divide the configuration 154 or 158 into multiple fluid circuits.

Using the above terminology, FIG. 1 illustrates a single-row assembly 146 in a series configuration 154 between the inlet header 59 and the outlet header 61, whereby the coils 14*a*, 14*b* in the single-row assembly 146 are grouped into a fluid series connection. Also, using the above terminology, FIG. 4 illustrates a single-row assembly 150 in a parallel configuration 158 between the inlet header 74 and the outlet header 86, whereby the coils 64*a*, 64*b* in the single-row assembly 150 are grouped into a fluid parallel connection.

FIG. 10 illustrates a third construction of a condenser assembly 170 including three two-row assemblies 138 in a parallel configuration 158 between an inlet header 174 and an outlet header 178. Each two-row assembly 138 includes two microchannel condenser coils 14*a*, 14*b* grouped in a fluid series connection. Rather than being permanently connected to the inlet and outlet headers 174, 178, respectively, the coils 14*a*, 14*b* may be coupled to the inlet and outlet headers 174, 178 by fluid-tight releasable couplings 182. The couplings 182 are illustrated in FIG. 10, and may comprise any known suitable fluid-tight, quick-release coupling and/or releasable coupling. By using the couplings 182 in place of permanently connecting the coils 14*a*, 14*b* to the inlet and outlet headers 174, 178, the assemblies 138 are permitted to be removed and/or replaced to accommodate a varying heat load or to permit serviceability of a damaged assembly 138.

The condenser assembly 170 also includes an oversized outlet header 178 that also acts as a receiver for the liquid refrigerant discharged from the coils 14*a*, 14*b*. One or more liquid refrigerant outlets 186 may extend from the oversized outlet header 178 to distribute the liquid refrigerant to the one or more evaporators in the refrigeration system.

Figure 11:
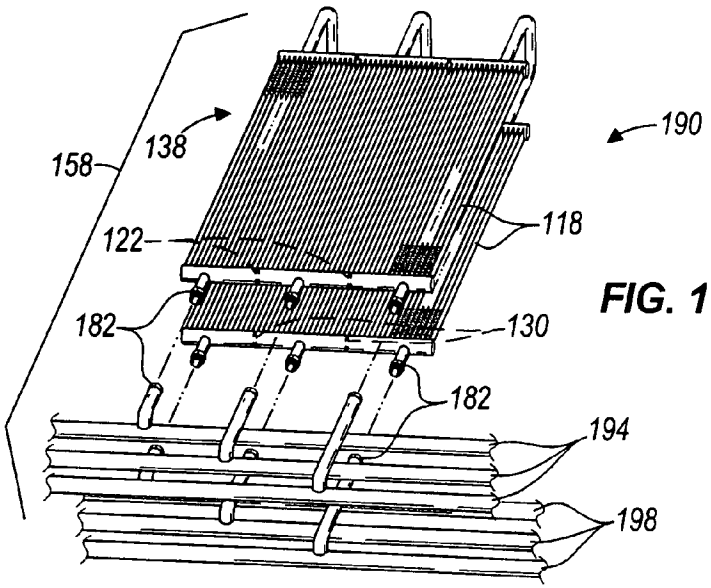
FIG. 11 is a perspective view of a fourth construction of a condenser assembly of the present invention.

FIG. 11 illustrates a fourth construction of a condenser assembly 190 including a two-row assembly 138, with three separate and distinct fluid circuits, in a parallel configuration 158 between multiple inlet headers 194 and multiple outlet headers 198. The two-row assembly 138 includes two microchannel condenser coils 118 grouped in a fluid series connection. As previously explained, the coils 118 each include respective baffles 122, 130 in the inlet and outlet manifolds 126, 134 to establish separate and distinct fluid circuits through the assembly 138. Like the assemblies 138 of FIG. 10, the assembly 138 of FIG. 11 may utilize fluid-tight couplings 182 to permit removal and/or replacement of the assembly 138 to accommodate a varying heat load or to permit serviceability of a damaged assembly 138.

Figure 12:
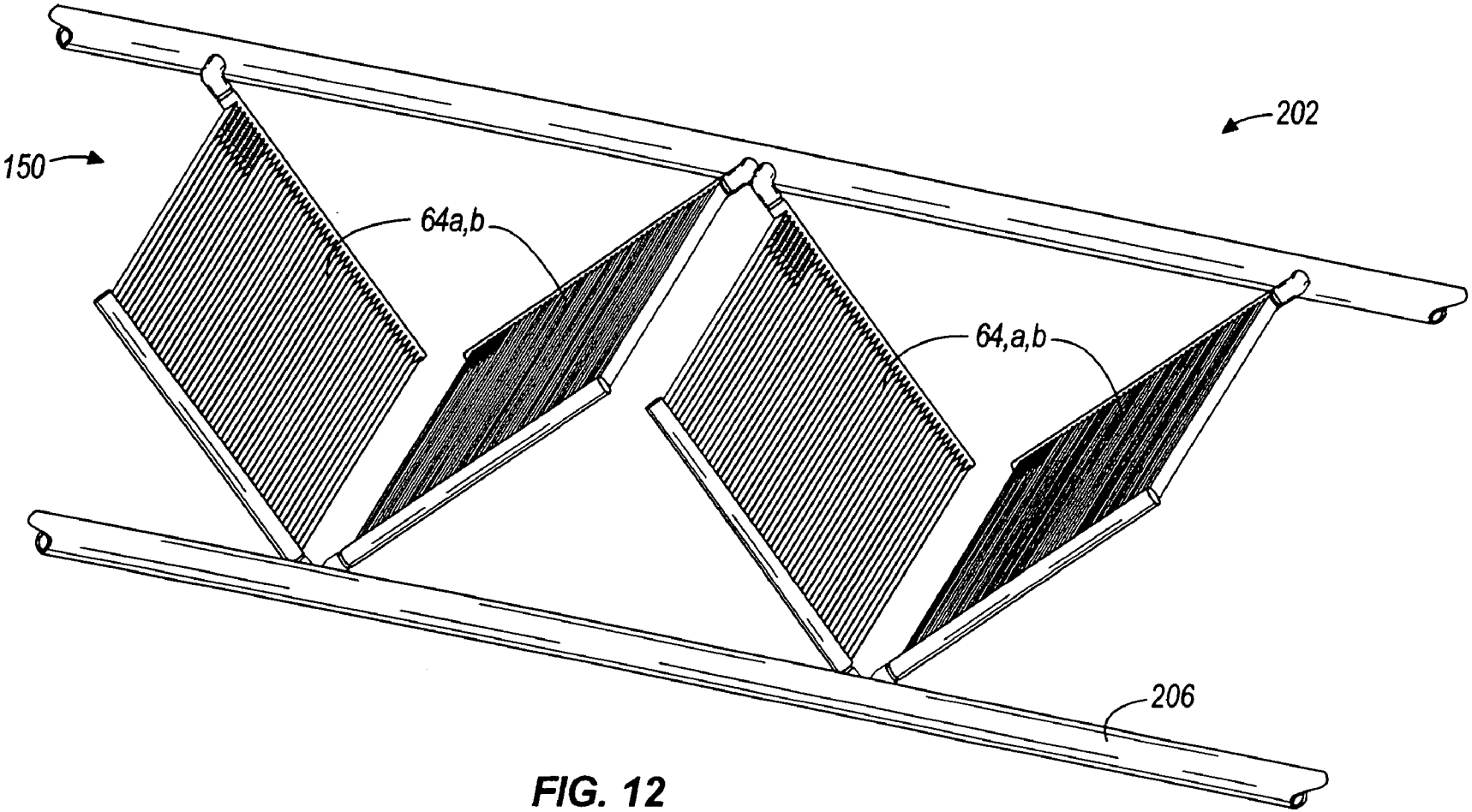
FIG. 12 is a perspective view of a fifth construction of a condenser assembly of the present invention.

FIG. 12 illustrates a fifth construction of a condenser assembly 202 including a single-row assembly 150 between an inlet header 206 and an outlet header 210. The single-row assembly 150 includes four microchannel condenser coils 64*a*, 64*b* grouped in a fluid parallel connection. The coils 64*a*, 64*b* are inclined with respect to the inlet and outlet headers 206, 210, such that the footprint of the condenser assembly 202 is reduced (compared to the assembly 62 of FIG. 4, for example). Although FIG. 12 generally illustrates the coils 64*a*, 64*b*, it should be known that any of the coils 14*a*, 14*b*, 64*a*, 64*b*, 98, or 118 may be used in forming the assembly 150.

As indicated by FIGS. 1, 4, and 10–12, the condenser assemblies 10, 62, 170, 190, 202 can be relatively small or relatively large. If a relatively large heat load must be satisfied, a relatively large condenser assembly (such as the assembly 170 of FIG. 10) having a plurality of assemblies 138, 142, 146, or 150 may be used. However, if a relatively small heat load must be satisfied, a relatively small condenser assembly (such as the assemblies 10, 62 of FIGS. 1 and 4, respectively) having only one assembly 138, 142, 146, 150 may be used. The condenser assemblies 10, 62, 170, 190, 202 are shown for exemplary reasons only, and are not meant to limit the spirit and/or scope of the present invention.

We claim:

1. A condenser assembly adapted to condense a refrigerant for use in a retail store refrigeration system and to reject heat of the refrigerant to ambient air of the environment, the condenser assembly comprising:

a first condenser assembly including at least one standard-sized microchannel condenser coil including an inlet manifold and an outlet manifold, the inlet manifold having an inlet port for receiving the refrigerant, and the outlet manifold having an outlet port for discharging the refrigerant, an air moving device associated with the microchannel condenser coil and operable to move air through the microchannel condenser coil, and a frame supporting the air moving device and the microchannel condenser coil; and a second condenser assembly including at least one standard-sized microchannel condenser coil including an inlet manifold and an outlet manifold, the inlet manifold having an inlet port for receiving the refrigerant, and the outlet manifold having an outlet port for discharging the refrigerant, an air moving device associated with the microchannel condenser coil of the second condenser assembly and operable to move air through the microchannel condenser coil of the second condenser assembly, and a frame supporting the air moving device and the microchannel condenser coil of the second condenser assembly, the frames of the first and second condenser assemblies being coupled together.

2. The condenser assembly of claim 1, wherein the microchannel condenser coils of the first and second condenser assemblies each includes a plurality of cooling fins spaced thereon between 12 and 24 fins per inch.

3. The condenser assembly of claim 1, wherein the microchannel condenser coils of the first and second condenser assemblies each includes a plurality of microchannels fluidly connecting the inlet manifold and the outlet manifold, the microchannels measuring between about 0.5 mm by about 0.5 mm and about 4 mm by about 4 mm in cross-section.

4. A condenser assembly adapted to condense a refrigerant for use in a retail store refrigeration system and to reject heat of the refrigerant to ambient air of the environment, the condenser assembly comprising:

a first condenser assembly including a first standard-sized microchannel condenser coil configured such that the refrigerant makes at least one pass therethrough, and an air moving device associated with the first microchannel condenser coil and operable to move air through the first microchannel condenser coil;

a second condenser assembly including a second standard-sized microchannel condenser coil fluidly connected with the first microchannel condenser coil, the second microchannel condenser coil being configured such that the refrigerant makes at least one pass through the second microchannel condenser coil after making at least one pass through the first microchannel condenser coil, and an air moving device associate with the second microchannel condenser coil and operable to move air through the second microchannel condenser coil; and a frame supporting the first and second microchannel condenser coils.

5. The condenser assembly of claim 4, wherein the frame includes a first frame supporting the first microchannel condenser coil and the air moving device of the first condenser assembly and a second frame supporting the second microchannel condenser coil and the air moving device of the second condenser assembly, the first and second frames being coupled together.

6. The condenser assembly of claim 4, wherein at least one of the first and second microchannel condenser coils include a plurality of cooling fins spaced thereon between 12 and 24 fins per inch.

7. The condenser assembly of claim 4, wherein at least one of the first and second microchannel condenser coils include a plurality of microchannels fluidly connecting the inlet manifold and the outlet manifold, the microchannels measuring between about 0.5 mm by about 0.5 mm and about 4 mm by about 4 mm in cross-section.

8. The condenser assembly of claim 4, wherein the first and second microchannel condenser coils each include an inlet manifold and an outlet manifold, and wherein the outlet manifold of the first microchannel condenser coil is fluidly connected with the inlet manifold of the second microchannel condenser coil.

9. The condenser assembly of claim 8, wherein the respective inlet manifolds each include at least one inlet port, and the respective outlet manifolds each include at least one outlet port, and wherein the outlet port of the first microchannel condenser coil is coupled to the inlet port of the second microchannel condenser coil.

10. The condenser assembly of claim 4, wherein the second microchannel condenser coil is in a fluid series connection with the first microchannel condenser coil.

11. A condenser assembly adapted to condense a refrigerant for use in a retail store refrigeration system and to reject heat of the refrigerant to ambient air of the environment, the condenser assembly comprising:

a first condenser assembly including a first standard-sized microchannel condenser coil configured such that the refrigerant makes at least one pass therethrough, and an air moving device associated with the first microchannel condenser coil and operable to move air through the first microchannel condenser coil;

a second condenser assembly including a second standard-sized microchannel condenser coil configured such that the refrigerant makes at least one pass therethrough, and an air moving device associate with the second microchannel condenser coil and operable to move air through the second microchannel condenser coil;

an inlet header fluidly connected with the first and second microchannel condenser coils, the inlet header being configured to deliver the refrigerant to the first and second microchannel condenser coils;

an outlet header fluidly connected with the first and second microchannel condenser coils, the outlet header being configured to receive refrigerant from the first and second microchannel condenser coils, wherein the first and second microchannel condenser coils are connected to receive and deliver refrigerant in a parallel relationship between the inlet and outlet headers; and a frame supporting the first and second microchannel condenser coils.

12. The condenser assembly of claim 11, wherein the frame includes a first frame supporting the first microchannel condenser coil and the air moving device of the first condenser assembly and a second frame supporting the second microchannel condenser coil and the air moving device of the second condenser assembly, the first and second frames being coupled together.

13. The condenser assembly of claim 11, wherein at least one of the first and second microchannel condenser coils include a plurality of cooling fins spaced thereon between 12 and 24 fins per inch.

14. The condenser assembly of claim 11, wherein the first and second microchannel condenser coils each include an inlet manifold and an outlet manifold.

15. The condenser assembly of claim 14, wherein the inlet and outlet manifolds of the first and second microchannel condenser coils are fluidly connected by a plurality of microchannels, the microchannels measuring between about 0.5 mm by about 0.5 mm and about 4 mm by about 4 mm in cross-section.

16. The condenser assembly of claim 14, wherein the inlet manifolds of the first and second microchannel condenser coils are fluidly connected with the inlet header.

17. The condenser assembly of claim 16, wherein the inlet manifolds of the first and second microchannel condenser coils each include at least one inlet port, the at least one inlet port of the first microchannel condenser coil being coupled to the inlet header, and the at least one inlet port of the second microchannel condenser coil being coupled to the inlet header.

18. The condenser assembly of claim 14, wherein the outlet manifolds of the first and second microchannel condenser coils are fluidly connected with the outlet header.

19. The condenser assembly of claim 18, wherein the outlet manifolds of the first and second microchannel condenser coils each include at least one outlet port, the at least one outlet port of the first microchannel condenser coil being coupled to the outlet header, and the at least one outlet port of the second microchannel condenser coil being coupled to the outlet header.

20. A method of assembling a condenser assembly adapted to condense a refrigerant for use in a retail store refrigeration system and to reject heat of the refrigerant to ambient air of the environment, the method comprising:

providing a first condenser assembly including a first standard-sized microchannel condenser coil configured such that the refrigerant makes at least one pass therethrough, and an air moving device associated with the first microchannel condenser coil and operable to move air through the first microchannel condenser coil;

providing a second condenser assembly including a second standard-sized microchannel condenser coil configured such that the refrigerant makes at least one pass therethrough, and an air moving device associated with the second microchannel condenser coil and operable to move air through the second microchannel condenser coil;

fluidly connecting the first microchannel condenser coil to a second microchannel condenser coil configured such that the refrigerant makes at least one pass through the second microchannel condenser after making at least one pass through the first microchannel condenser coil; and supporting the first and second microchannel condenser coils with a frame.

21. The method of claim 20, further comprising supporting the first microchannel condenser coil and the air moving device of the first condenser assembly with a first frame and supporting the second microchannel condenser coil and the air moving device of the second condenser assembly with a second frame, and coupling together the first and second frames.

22. The method of claim 20, wherein fluidly connecting the first microchannel condenser coil to the second microchannel condenser coil includes coupling an outlet port of the first microchannel condenser coil with an inlet port of the second microchannel condenser coil.

23. The method of claim 20, further comprising:

calculating a total heat load of the refrigeration system; and determining how many standard-sized microchannel condenser coils should be fluidly interconnected.

24. A method of assembling a condenser assembly adapted to condense a refrigerant for use in a retail store refrigeration system and to reject heat of the refrigerant to ambient air of the environment, the method comprising:

providing a first condenser assembly including a first standard-sized microchannel condenser coil configured such that the refrigerant makes at least one pass therethrough, and an air moving device associated with the first microchannel condenser coil and operable to move air through the first microchannel condenser coil;

providing a second condenser assembly including a second standard-sized microchannel condenser coil configured such that the refrigerant makes at least one pass therethrough, and an air moving device associated with the second microchannel condenser coil and operable to move air through the second microchannel condenser coil;

fluidly connecting an inlet header to the first and second microchannel condenser coils, the inlet header being configured to deliver the refrigerant to the first and second microchannel condenser coils;

fluidly connecting an outlet header to the first and second microchannel condenser coils, the outlet header being configured to receive the refrigerant from the first and second microchannel condenser coils, wherein the first and second microchannel condenser coils are connected to receive and deliver refrigerant in a parallel relationship between the inlet and outlet headers; and supporting the first and second microchannel condenser coils with a frame.

25. The method of claim 24, further comprising supporting the first microchannel condenser coil and the air moving device of the first condenser assembly with a first frame and supporting the second microchannel condenser coil and the air moving device of the second condenser assembly with a second frame, and coupling together the first and second frames.

26. The method of claim 24, wherein fluidly connecting the inlet header to the first and second microchannel condenser coils includes coupling respective inlet ports of the first and second microchannel condenser coils to the inlet header.

27. The method of claim 24, wherein fluidly connecting the outlet header to the first and second microchannel condenser coils includes coupling respective outlet ports of the first and second microchannel condenser coils to the outlet header.

28. The method of claim 24, further comprising:

calculating a total heat load of the refrigeration system; and determining how many standard-sized microchannel condenser coils should be fluidly interconnected.

* * * * *

US006988538C1

(12) EX PARTE REEXAMINATION CERTIFICATE (10183rd)

United States Patent

Merkys et al.

(10) Number: US 6,988,538 C1

(45) Certificate Issued: Jun. 5, 2014

(54) MICROCHANNEL CONDENSER ASSEMBLY

(75) Inventors: Justin P. Merkys, Barrington, IL (US); Doug McAlpine, Bartlett, IL (US); Susan A. Seaman, Streamwood, IL (US); Norman E. Street, O'Fallon, MO (US)

(73) Assignee: Hussman Corporation, Bridgeton, MO (US)

Reexamination Request:
No. 90/009,842, Dec. 22, 2010
No. 90/009,892, Apr. 14, 2011

Reexamination Certificate for:

| | |
|---|---|
| Patent No.: | **6,988,538** |
| Issued: | **Jan. 24, 2006** |
| Appl. No.: | **10/762,416** |
| Filed: | **Jan. 22, 2004** |

(51) Int. Cl.
*F28F 1/10* (2006.01)

(52) U.S. Cl.
USPC ..... 165/122; 29/890.03; 165/175

(58) Field of Classification Search
USPC ..... 165/122, 144, 145, 173, 175; 29/890.03, 890.035
See application file for complete search history.

(56) References Cited

To view the complete listing of prior art documents cited during the proceedings for Reexamination Control Numbers 90/009,842 and 90/009,892, please refer to the USPTO's public Patent Application Information Retrieval (PAIR) system under the Display References tab.

*Primary Examiner* — Catherine S. Williams

(57) ABSTRACT

A condenser assembly adapted to condense an evaporated refrigerant for use in a retail store refrigeration system. The condenser assembly includes at least one microchannel condenser coil including an inlet manifold and an outlet manifold. The inlet manifold includes an inlet port for receiving the refrigerant, and the outlet manifold includes an outlet port for discharging the refrigerant. The condenser assembly also includes a frame supporting the at least one microchannel condenser coil.

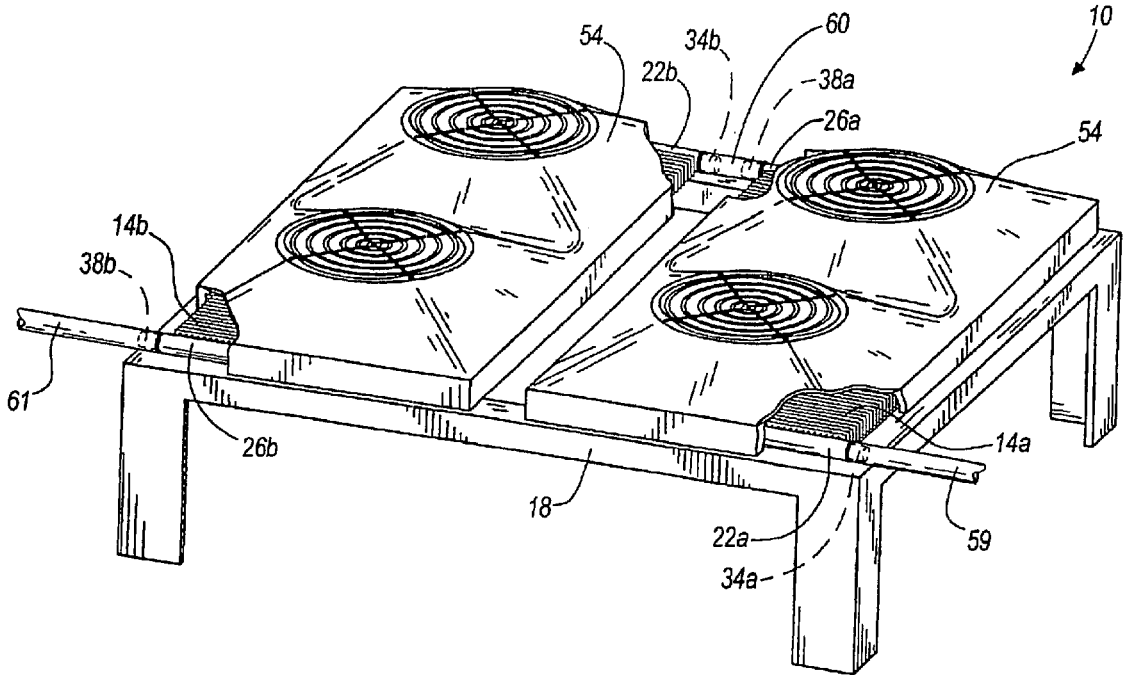

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 5, line 66-column 6, line 18:

The condenser assembly 10 also includes fans 50 coupled to the microchannel condenser coils 14a, 14b to provide an airflow through the coils 14a, 14b. As shown in FIGS. 1 and 2, each microchannel condenser coil 14a, 14b includes two fans 50 mounted thereon. Alternatively, centrifugal blowers (not shown) may be used in place of the fans 50 or in combination with the fans 50. The fans 50 are supported in a fan shroud 54, which guides the airflow generated by the fans 50 through the microchannel condenser coils 14a, 14b, and helps distribute the airflow amongst the face of each condenser coil 14a, 14b. *In other words, supporting the fans 50 over the face of each condenser coil 14a, 14b as illustrated in FIGS. 1 and 2 allows operation of the fans 50 to control the face velocity of the airflow distributed by the air moving device 54 through each condenser coil 14a, 14b.* In a preferred construction of the condenser assembly 10, the fans 50 may be "low-noise" fans, like the SWEPTWING™ fans available from Revcor, Inc. of Carpentersville, Ill. to help decrease noise emissions from the condenser assembly 10. In other constructions of the condenser assembly 10, more or less than two fans 50 may be used for each condenser coil 14a, 14b to generate the airflow through the condenser coil 14a, 14b. Also, the fans 50 and/or the shroud 54 may comprise any number of designs different than that shown in FIGS. 1-2.

Column 7, lines 7-33:

During operation of the refrigeration system utilizing the condenser assembly 10 of FIG. 1, the compressed, gaseous refrigerant is pumped into the first microchannel condenser coil 14a, where the heat transfer between the airflow passing through the condenser coil 14a and the refrigerant causes the gaseous refrigerant to at least partially condense as the refrigerant passes through the flat tubes 30. If baffles are not placed in either of the inlet or outlet manifolds 22a, 26a of the first microchannel condenser coil 14a, the refrigerant will make one pass from the inlet manifold 22a to the outlet manifold 26a before being discharged from the first microchannel condenser coil 14a. Further, the fans 50 may be activated to provide and/or enhance the airflow through the first microchannel condenser coil 14a (*i.e., to control the face velocity of the airflow through the first condenser coil 14a*) to further enhance cooling of the refrigerant.

Column 7, lines 34-49:

Since the condenser coils 14a, 14b are connected in a series arrangement, the refrigerant is passed from the first microchannel condenser coil 14a to the second microchannel condenser coil 14b. If only a portion of the compressed, gaseous refrigerant is condensed in the first microchannel condenser coil 14a, then the remaining portion is condensed in the second microchannel condenser coil 14b. Like the first microchannel condenser coil 14a, if baffles are not placed in either of the inlet or outlet manifolds 22b, 26b of the second microchannel condenser coil 14b, the refrigerant will make one pass from the inlet manifold 22b to the outlet manifold 26b before being discharged from the second microchannel condenser coil 14b. Further, the fans 50 may be activated to provide and/or enhance the airflow through the second microchannel condenser coil 14b (*i.e., to control the face velocity of the airflow through the second condenser coil 14b*) to further enhance cooling of the refrigerant.

AS A RESULT OF REEXAMINATION, IT HAS BEEN DETERMINED THAT:

The patentability of claims 11, 13-19, 24 and 26-28 is confirmed.

Claims 1, 4-5, 12, 20-21 and 25 are determined to be patentable as amended.

Claims 2-3, 6-10 and 22-23, dependent on an amended claim, are determined to be patentable.

New claims 29-34, 35 and 36 are added and determined to be patentable.

1. A condenser assembly adapted to condense a refrigerant for use in a retail store refrigeration system and to reject heat of the refrigerant to ambient air of the environment, the condenser assembly comprising:

a first condenser assembly including at least one standard-sized microchannel condenser coil including an inlet manifold and an outlet manifold, the inlet manifold having an inlet port for receiving the refrigerant, and the outlet manifold having an outlet port for discharging the refrigerant, an air moving device associated with the microchannel condenser coil and operable to move air through the microchannel condenser coil, and a frame supporting the air moving device and the microchannel condenser coil; and a second condenser assembly including at least one standard-sized microchannel condenser coil including an inlet manifold and an outlet manifold, the inlet manifold having an inlet port for receiving the refrigerant, and the outlet manifold having an outlet port for discharging the refrigerant, an air moving device associated with the microchannel condenser coil of the second condenser assembly and operable to move air through the microchannel condenser coil of the second condenser assembly, and a frame supporting the air moving device and the microchannel condenser coil of the second condenser assembly, the frames of the first and second condenser assemblies being coupled together,

*wherein the microchannel condenser coil of the first condenser assembly and the microchannel condenser coil of the second condenser assembly are the same size.*

4. A condenser assembly adapted to condense a refrigerant for use in a retail store refrigeration system and to reject heat of the refrigerant to ambient air of the environment, the condenser assembly comprising:

a first condenser assembly including a first standard-sized microchannel condenser coil configured such that the refrigerant makes at least one pass therethrough, and an air moving device associated with the first microchannel condenser coil and operable to move air through the first microchannel condenser coil;

a second condenser assembly including a second standard-sized microchannel condenser coil fluidly connected with the first microchannel condenser coil, the second microchannel condenser coil being configured such that the refrigerant makes at least one pass through the second microchannel condenser coil after making at least one pass through the first microchannel condenser coil, and an air moving device associated with the second microchannel condenser coil and operable to move air through the second microchannel condenser coil; and a frame supporting the first and second microchannel condenser coils,

*wherein the first microchannel condenser coil and the second microchannel condenser coil are the same size.*

5. The condenser assembly of claim [4] *31*, wherein the frame includes a first frame supporting the first microchannel condenser coil and the air moving device of the first condenser assembly and a second frame supporting the second microchannel condenser coil and the air moving device of the second condenser assembly, the first and second frames being coupled together, the first air moving device moving air through the first microchannel condenser coil and not the second microchannel condenser coil, and the second air moving device moving air through the second microchannel condenser coil and not the first microchannel condenser coil such that the amount of airflow through each microchannel coil is independent of the quantity of condenser assemblies coupled together.

12. The condenser assembly of claim [11] *32*, wherein the frame includes a first frame supporting the first microchannel condenser coil and the air moving device of the first condenser assembly and a second frame supporting the second microchannel condenser coil and the air moving device of the second condenser assembly, the first and second frames being coupled together, the first air moving device moving air through the first microchannel condenser coil and not the second microchannel condenser coil, and the second air moving device moving air through the second microchannel condenser coil and not the first microchannel condenser coil such that the amount of airflow through each microchannel coil is independent of the quantity of condenser assemblies coupled together.

20. A method of assembling a condenser assembly adapted to condense a refrigerant for use in a retail store refrigeration system and to reject heat of the refrigerant to ambient air of the environment, the method comprising:

providing a first condenser assembly including a first standard-sized microchannel condenser coil configured such that the refrigerant makes at least one pass therethrough, and an air moving device associated with the first microchannel condenser coil and operable to move air through the first microchannel condenser coil;

providing a second condenser assembly including a second standard-sized microchannel condenser coil configured such that the refrigerant makes at least one pass therethrough, and an air moving device associated with the second microchannel condenser coil and operable to move air through the second microchannel condenser coil;

fluidly connecting the first microchannel condenser coil to [a] *the* second microchannel condenser coil configured such that the refrigerant makes at least one pass through the second microchannel condenser after making at least one pass through the first microchannel condenser coil; and supporting the first and second microchannel condenser coils with a frame,

*wherein the first microchannel condenser coil and the second microchannel condenser coil are the same size.*

21. The method of claim [20] *33*, further comprising supporting the first microchannel condenser coil and the air moving device of the first condenser assembly with a first frame and supporting the second microchannel condenser coil and the air moving device of the second condenser assembly with a second frame, and coupling together the first and second frames, the first air moving device moving air through the first microchannel condenser coil and not the second microchannel condenser coil, and the second air moving device moving air through the second microchannel condenser coil and not the first microchannel condenser coil such that the amount of airflow through each microchannel coil is independent of the quantity of condenser assemblies coupled together.

25. The method of claim [24] *34*, further comprising supporting the first microchannel condenser coil and the air moving device of the first condenser assembly with a first frame and supporting the second microchannel condenser coil and the air moving device of the second condenser assembly with a second frame, and coupling together the first and second frames, the first air moving device moving air through the first microchannel condenser coil and not the second microchannel condenser coil, and the second air moving device moving air through the second microchannel condenser coil and not the first microchannel condenser coil such that the amount of airflow through each microchannel coil is independent of the quantity of condenser assemblies coupled together.

*29. The condenser assembly of claim 1, wherein the air moving device of each of the first and second condenser assembly is associated only with the microchannel condenser coil of the respective condenser assembly, and wherein each air moving device is operable to move air through the corresponding microchannel condenser coil to distribute the airflow amongst the face of the microchannel condenser coil to control the face velocity of airflow through the microchannel condenser coil.*

*30. The condenser assembly of claim 29, wherein the frames of the first and second condenser assemblies are coupled together, the first air moving device moving air through the first microchannel condenser coil and not the second microchannel condenser coil, and the second air moving device moving air through the second microchannel condenser coil and not the first microchannel condenser coil such that the amount of airflow through each microchannel coil is independent of the quantity of condenser assemblies coupled together.*

*31. The condenser assembly of claim 4, wherein the air moving device of each of the first and second condenser assembly is associated only with the microchannel condenser coil of the respective condenser assemblies, and wherein each air moving device is operable to move air through the corresponding microchannel condenser coil to distribute the airflow amongst the face of the microchannel condenser coil to control the face velocity of airflow through the microchannel condenser coil.*

*32. The condenser assembly of claim 11, wherein the air moving device of each of the first and second condenser assembly is associated only with the microchannel condenser coil of the respective condenser assemblies, and wherein each air moving device is operable to move air through the corresponding microchannel condenser coil to distribute the airflow amongst the face of the microchannel condenser coil to control the face velocity of airflow through the microchannel condenser coil.*

*33. The method of claim 20, further comprising associating the air moving device of each of the first microchannel condenser coil and the second microchannel condenser coil only with the respective microchannel condenser coil to distribute the airflow amongst the face of the associated microchannel condenser coil to control the face velocity of airflow through the microchannel condenser coil.*

*34. The method of claim 24, further comprising associating the air moving device of each of the first microchannel condenser coil and the second microchannel condenser coil only with the respective microchannel condenser coil to distribute the airflow amongst the face of the associated microchannel condenser coil to control the face velocity of airflow through the microchannel condenser coil.*

*35. The condenser assembly of claim 11, wherein the first microchannel condenser coil and the second microchannel condenser coil are the same size.*

*36. The method of claim 24, wherein the first microchannel condenser coil and the second microchannel condenser coil are the same size.*

* * * * *